US005255908A

United States Patent [19]

Hiroi et al.

[11] Patent Number: 5,255,908

[45] Date of Patent: Oct. 26, 1993

[54] SHEET SORTER WITH CONTROL FOR CONTINUOUS OPERATION

[75] Inventors: Masakazu Hiroi, Yokohama; Mitsuhiro Mukasa, Kawasaki; Kenji Kobayashi, Tokyo, all of Japan

[73] Assignee: Canon Kabushiki Kaisha, Tokyo, Japan

[21] Appl. No.: 914,035

[22] Filed: Jul. 15, 1992

Related U.S. Application Data

[63] Continuation of Ser. No. 597,335, Oct. 15, 1990, abandoned.

[30] Foreign Application Priority Data

Oct. 18, 1989 [JP] Japan ..... 1-271146

[51] Int. Cl.[5] ..... B65H 39/10

[52] U.S. Cl. ..... 271/293; 271/294; 270/53; 270/58

[58] Field of Search ..... 271/292, 293, 294; 270/45, 53, 58

[56] References Cited

U.S. PATENT DOCUMENTS

| | | | |
|---|---|---|---|
| 4,328,963 | 5/1982 | DuBois et al. | 271/293 |
| 4,332,377 | 6/1982 | DuBois et al. | 271/293 |
| 4,337,936 | 7/1982 | Lawrence | 271/293 |
| 4,343,463 | 8/1982 | Lawrence | 271/293 |
| 4,466,608 | 8/1984 | DuBois et al. | 271/293 |
| 4,561,765 | 12/1985 | Masuda . | |
| 4,647,034 | 3/1987 | Sawa | 271/294 X |
| 4,854,571 | 8/1989 | Kitajima et al. | 271/294 X |

FOREIGN PATENT DOCUMENTS

| | | | |
|---|---|---|---|
| 0288881 | 11/1988 | European Pat. Off. . | |
| 3044783 | 6/1981 | Fed. Rep. of Germany . | |
| 3117480 | 3/1982 | Fed. Rep. of Germany . | |
| 3116940 | 7/1982 | Fed. Rep. of Germany . | |
| 3151692 | 8/1982 | Fed. Rep. of Germany . | |
| 3339952 | 5/1984 | Fed. Rep. of Germany | 271/293 |
| 158762 | 9/1984 | Japan | 271/293 |
| 191372 | 8/1987 | Japan | 271/293 |

*Primary Examiner*—Robert P. Olszewski
*Assistant Examiner*—Boris Milef, Jr.
*Attorney, Agent, or Firm*—Fitzpatrick, Cella, Harper & Scinto

[57] ABSTRACT

The present invention provides a sheet sorting apparatus with plural bins trays; bin tray moving device for moving the bin trays stepwise to cause each of the bin trays to face a sheet receiving position; and a controller for controlling the operating speed of the bin tray moving device according to sheet transporting information of an image forming apparatus to be connected to said sorting apparatus, in such a manner that said bin tray moving means can be operated in continuous manner even during the discharge of a sheet into a bin tray.

22 Claims, 29 Drawing Sheets

SHEET SORTER WITH CONTROL FOR CONTINUOUS OPERATION

This application is a continuation of application Ser. No. 07/597,335 filed Oct. 15, 1990, now abandoned.

BACKGROUND OF THE INVENTION

Field of the Invention

The present invention relates to an apparatus, hereinafter called sorter, used for sorting or collation of sheet-shaped members such as copy sheets, transfer sheets or recording sheets (hereinafter called "sheets") discharged from an image forming apparatus such as a copying machine, a printing press or other recording equipment, and to an image forming apparatus equipped with such sheet sorter.

Related Background Art

In general, such sorter is equipped with 10 to 20, or more stepped sheet stackers (hereinafter called "bins") in a mutually spaced arrangement, and the sheets consecutively discharged from the image forming apparatus at a predetermined interval are transported in succession to respective bins by transporting means utilizing a conveyor belt and/or plural rollers.

Such sorters can be classified into either movable bin sorters in which a group of bins for sheet collation moves with respect to a fixed transport path, or fixed bin sorters in which the bins are fixed while a discharge unit moves in succession corresponding to said bins or sheets are fed into the bins from a main path by means of flappers (deflecting means).

In the conventional movable bin sorters there are already proposed methods for moving the bins so as to widen the entrance of a bin when said bin moves to a sheet receiving position, as disclosed, for example, in the Japanese Laid-open Patents Nos. 56-78770, 56-78769, 57-4855, 57-4856, and 57-141357, which correspond to U.S. Pat. Nos. 4,328,963; 4,343,463; 4,466,608; 4,337,936and 4,332,377, respectively.

In such apparatus, paired trunnions, mounted on the entrance end of each bin, are made to engage with a widening mechanism utilizing a rotary geneva or a lead cam, thereby widening the spaces of the bins in succession at the sheet introducing position, and this operation is gradually displaced over the widening mechanism, thereby achieving the ascent or descent of the entire bin group.

An example of the principal part of such sheet sorter is illustrated in FIGS. 1A and 1B. Bin rollers 151*a*, 151*b*, 151*c* provided on both sides of each of plural bins Ba, Bb, Bc are vertically movably guided by a pair of guide rails 152 positioned at left and right, and further engage, at the end portions of said bin rollers, with cam grooves of a pair of lead cams 153*a*, 153*b* provided at left and right, thereby being elevated or lowered by the rotation of said lead cams 153*a*, 153*b* in a direction A, D or in the opposite direction. When the bin rollers 151*a*, 151*b* are in the illustrated position on the lead cams 153*a*, 153*b*, the space between the bins Ba and Bb and that between the bins Bb and Bc are locally widened, thereby facilitating the reception of sheet from discharge rollers 155 of the main body. The bins Ba, Bb, . . . after the sheet reception are closely stacked in succession above or below.

Such apparatus achieves high efficiency by supporting the entire weight of the bin unit (bin group) by the upper faces of the lead cams 153*a*, 153*b* and elevating or lowering each bin roller by a turn of the lead cams 153*a*, 153*b*. Thus such apparatus is featured by a simple mechanical structure and can achieve necessary functions.

Another advantage of the movable bin sorter lies in a fact that the sheet transportation can be achieved very reliably with a simple structure, since the transport path to the discharge rollers 155 for discharging the sheet from the main body of the image forming apparatus into the sorter is constant regardless of the number of bits.

On the other hand, FIGS. 2A and 2B illustrate examples of the fixed bin sorter. Referring to FIG. 2A, above plural bins B fixed in the sorter, there is provided a transport path 157 having plural pairs of guide rollers 156. Paired discharge rollers 159 are vertically movably provided along the entrances of the bins B, and support a guide belt 162 in cooperation with upper and lower guide rollers 160, 161. Also a sheet path 165 for guiding downwards the sheet discharged from the transport path 157 is formed by said guide belt 162 and by an elastic member 163 of which an end is fixed on the discharge rollers 159*a*, 159*b* and the upper end portion has the tendency to wind spirally.

The above-explained apparatus introduces the sheet discharged from the transport path 157 into respective bins by positioning the paired discharged rollers 159*a*, 159*b* respectively corresponding said bins, and said discharge rollers 159*a*, 159*b* are used as an indexer for each bin.

In the structure shown in FIG. 2B, in a transport path provided facing to all the bins of the sorter, there are provided deflector means 166, such as flappers, respectively corresponding to said bins. Thus the sheet discharged from the transport path 157 can be introduced into each bin, by activating the deflector means 166 corresponding to said bin.

However the conventional movable bin sorter and the conventional fixed bin sorter have mutually contradicting drawbacks as will be explained in the following.

At first, the fixed bin sorter is generally more advantageous than the movable bin sorter in terms of noise, since the former need not move the considerably heavy bin unit. On the other hand, in the fixed bin sorter with the discharge unit used as the indexer, the length of sheet path to the indexer including the discharge rollers 159*a*, 159*b* varies according to the bin into which the sheet is to be introduced. For this reason there is required means for absorbing the difference in path length for example between the 1st and 20th bins (for example a belt and a tensioner for supporting said belt, for absorbing the difference in length), thereby inevitably elevating the cost of the apparatus. Also the reliability of the sheet path itself is deteriorated with the complication of the structure of the apparatus.

Also the fixed bin sorter with flappers 166 respectively corresponding to the bins is advantageous in terms of noise reduction, but the cost is inevitably elevated since the number of flappers 166 and driving components such as solenoids increases with the increase in the number of bins.

In summary, the fixed bin sorter is high in cost, and is inferior in the reliability of sheet path to the movable bin sorter.

The movable bin sorter is generally superior to the fixed bin sorter in the reliability of sheet transportation, since the distance from the main body of the image forming apparatus to the sheet discharge position of the sorter is constant.

However it is inferior to the fixed bin sorter in noise generation, since the entire bin unit is moved so that respective bins face the sheet discharge position in succession, and the impact noises by the inertia at the vertical movement of the bin unit is unavoidable. With the ever increasing speed of the copying machines, there is required a correspondingly high-speed sorter in order to maintain the productivity of the entire copying system. For this purpose it is necessary to reduce the shifting time of the bins B, thereby completing the shift of the bins B within the time interval of the sheets discharged in succession from the copying machine.

Consequently it becomes necessary for example to increase the rotating speed of the above-mentioned lead cam 153*a*, so that the movable bin sorter is inferior to the fixed bin sorter in terms of noises, due to the increased impact noises resulting from the faster vertical movement of the bins. In summary, in comparison with the fixed bin sorter, the movable bin sorter can simplify the structure and provides higher reliability of the sheet path, but is inferior in the faster operation and the noise reduction.

Thus, among the conventional sorters, it is generally accepted that the movable bin sorters are suitable for achieving high reliability with a simple structure of low cost, while the fixed bin sorters are suitable for achieving high-speed operation and noise reduction.

SUMMARY OF THE INVENTION

The object of the present invention is to provide a movable bin sorter which maintains its inherent features of simplicity in structure and high reliability, and is capable of achieving high-speed operation and noise reduction, and an image forming apparatus equipped with such sorter.

The sorter of the present invention is featured by controlling the moving speed of means for moving the bin trays according to the feeding information, such as interval of sheet discharges, thereby discharging sheets into bin trays while continuously operating said moving means.

According to the above-mentioned feature of the present invention, the continuous operation of the moving means reduces the impact noises associated with intermittent operation and also reduces the loss in driving action.

More specifically, in an embodiment of the present invention, the cam of spiral cam means engaging with the trunnion of a bin facing the sheet discharge means is provided with a substantially horizontal portion of a predetermined amount, and the sheet discharge operation is synchronized with the passing of said trunnion through said substantially horizontal portion of the spiral cam means.

In the course of descent or ascent of plural bins by a trunnion at a time through the rotation of the spiral cam means, a bin for receiving the sheet is positioned corresponding to the sheet discharge means, and is widely separated from other bins. The sheet transported from the image forming apparatus into the sheet sorter is introduced into the bin from the sheet discharge means, during rotation of said spiral cam means. In this manner sheet discharges into predetermined bins are enabled without repeating the stoppage and start of ascent or descent of plural bins, whereby high-speed sheet discharge into the bin and noise reduction of bin movement can be achieved.

Also because of the presence of said horizontal portion in the spiral cam means at the sheet discharge position, the trunnion of the bin does not move vertically in the course of rotation of the spiral cam means, so that a sufficient sheet discharge time can be secured for each bin It is therefore rendered possible to rotate the spiral cam means at a high speed, and to satisfactorily sort the sheets discharged from a high-speed image forming apparatus.

BRIEF DESCRIPTION OF THE DRAWINGS

FIGS. 22 to 30A, 30B are flow charts showing the control sequence of the embodiments of the present invention;

DESCRIPTION OF THE PREFERRED EMBODIMENTS

In the following there will be explained a first embodiment of the present invention, with reference to the attached drawings.

Figure 4:
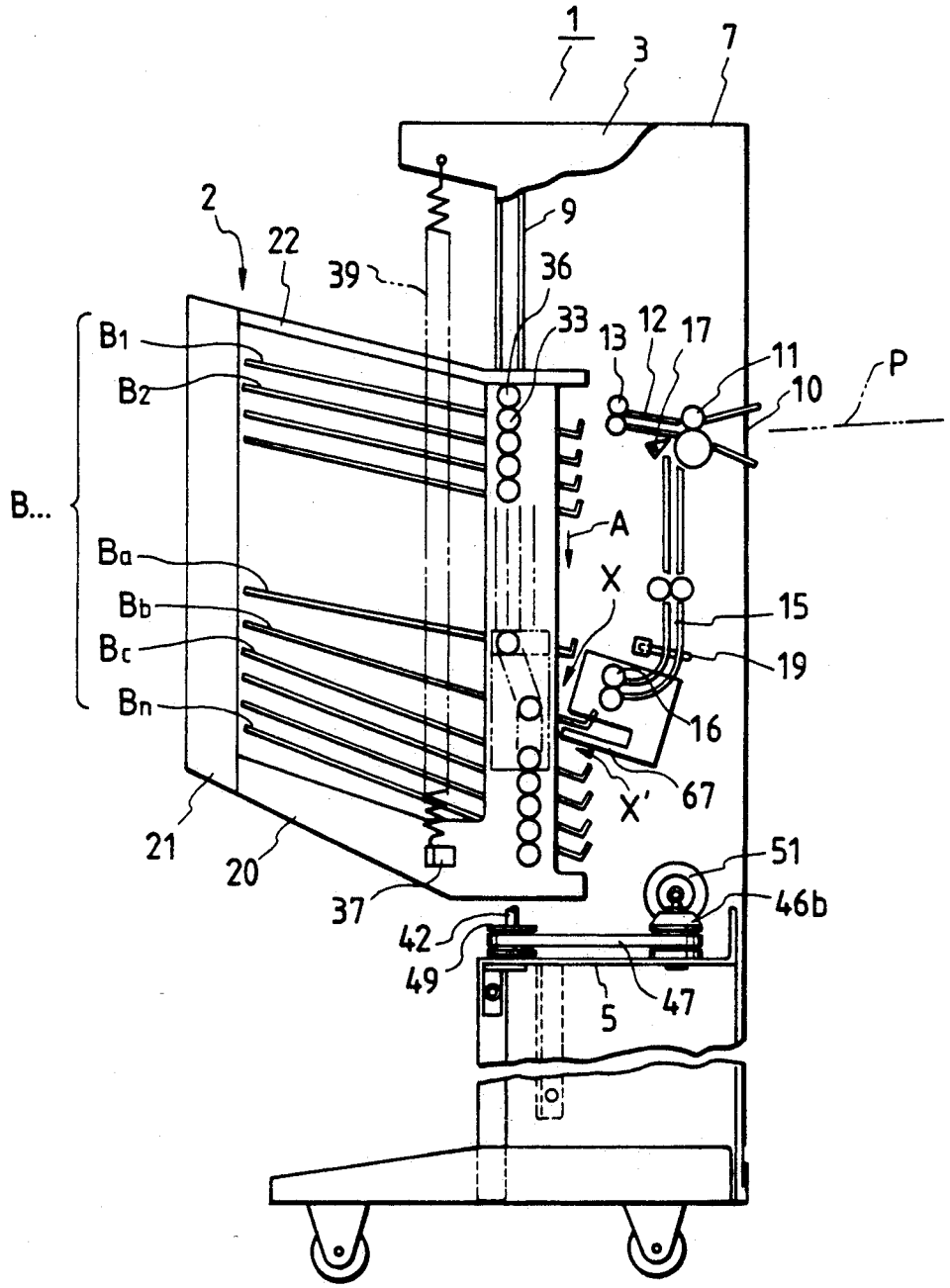
FIG. 4 is a longitudinal cross-sectional view of a sheet sorter constituting a first embodiment of the present invention.
Figure 5:
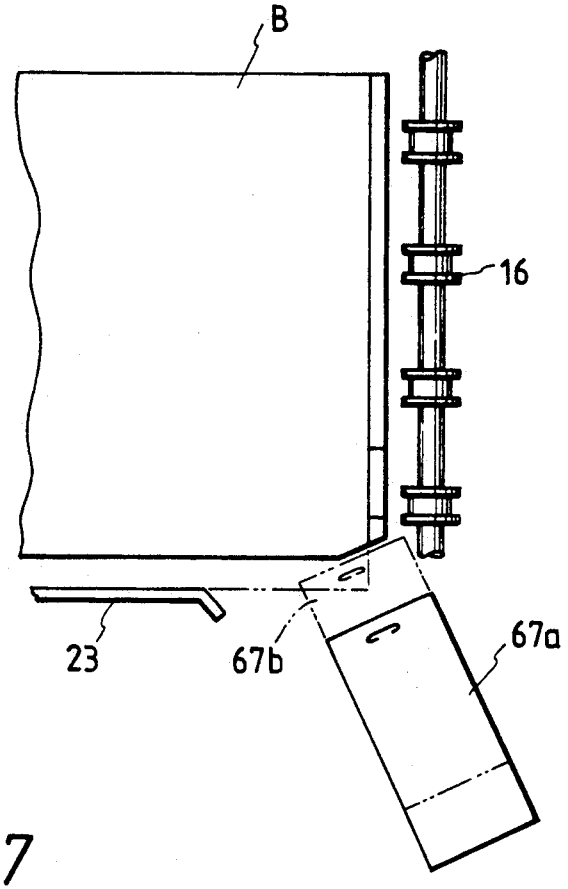
FIG. 5 is a view seen in a direction A shown in FIG. 4.
Figure 6:
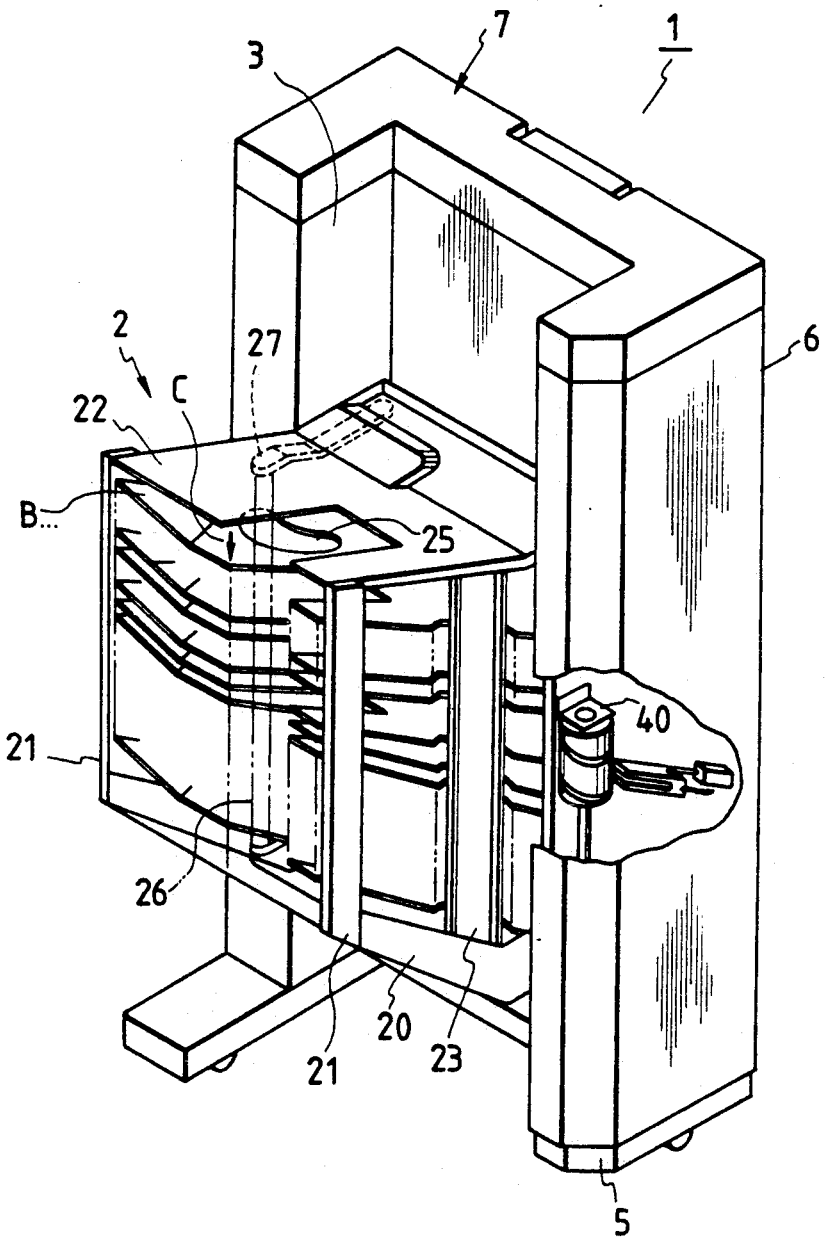
FIG. 6 is a perspective view of said sorter.

Referring to FIGS. 4 and 6, a movable bin sheet sorter 1 is provided with a main body 7 principally composed of a pair of side plates 3, a base member 5 and a cover 6. The sorter 1 is provided with a bin unit 2, incorporating a bin group B of plural bins B1~Bn, and is vertically movable along a pair of guide rails (guide members) 9 mounted on said side plates 3.

The sorter main body 7 is connected, at the upstream side (right-hand side in FIG. 4), to an image forming apparatus (not shown), and is provided with an entrance 10 and entrance rollers 11 for introducing the sheet P discharged from the image forming apparatus. From said paired rollers 11 toward said bin unit 2 there is extended a first sheet transport path 12 and upper discharge rollers 13, from which branched is a downward second sheet transport path 15 with lower discharge rollers 16 opposed to the bin unit 2. At the branching portion of said sheet transport paths 12, 15 there is provided a deflector 17, which is selectively displaced either to introduce the sheet P, to be discharged from the upper discharge rollers 13 to the bins B, into the first transport path 12 or to introduce the sheet P, to be discharged from the lower discharge rollers 16 to the bins B. into the second transport path 15.

In the vicinity of the sheet discharging portion of the second transport path 15 there is provided a sheet sensor 19 for detecting the sheet P. In the present embodiment said sheet sensor 19 is composed of a reed switch incorporating a photointerruptor, but a transmissive sensor may also be used for the same purpose. The sheet P discharged from the image forming apparatus (not shown) is detected by a discharge sensor provided in said apparatus. In the present embodiment, there can be measured the passing time of the sheet P and the interval of succeeding sheets P, and a calculating circuit incorporated in said apparatus sends a discharge signal and an interval signal to a microcomputer in said bin unit 2.

Figure 7:
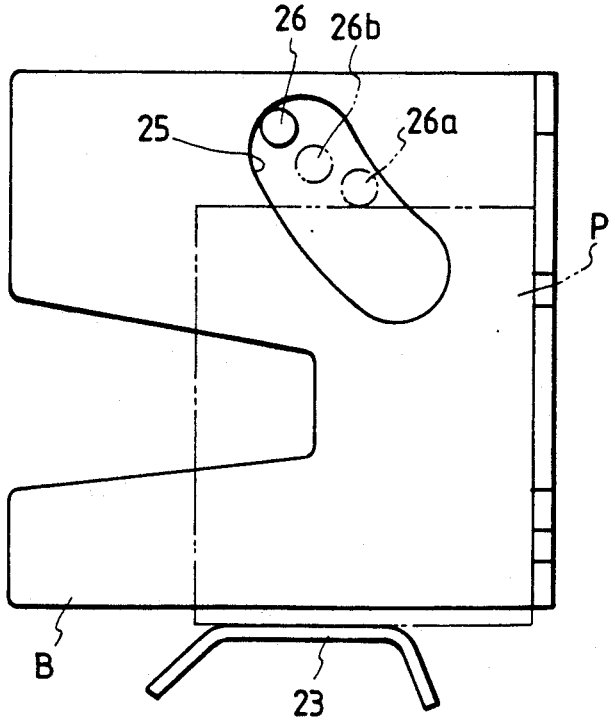
FIG. 7 is a view seen in a direction C shown in FIG. 6.
Figure 8:
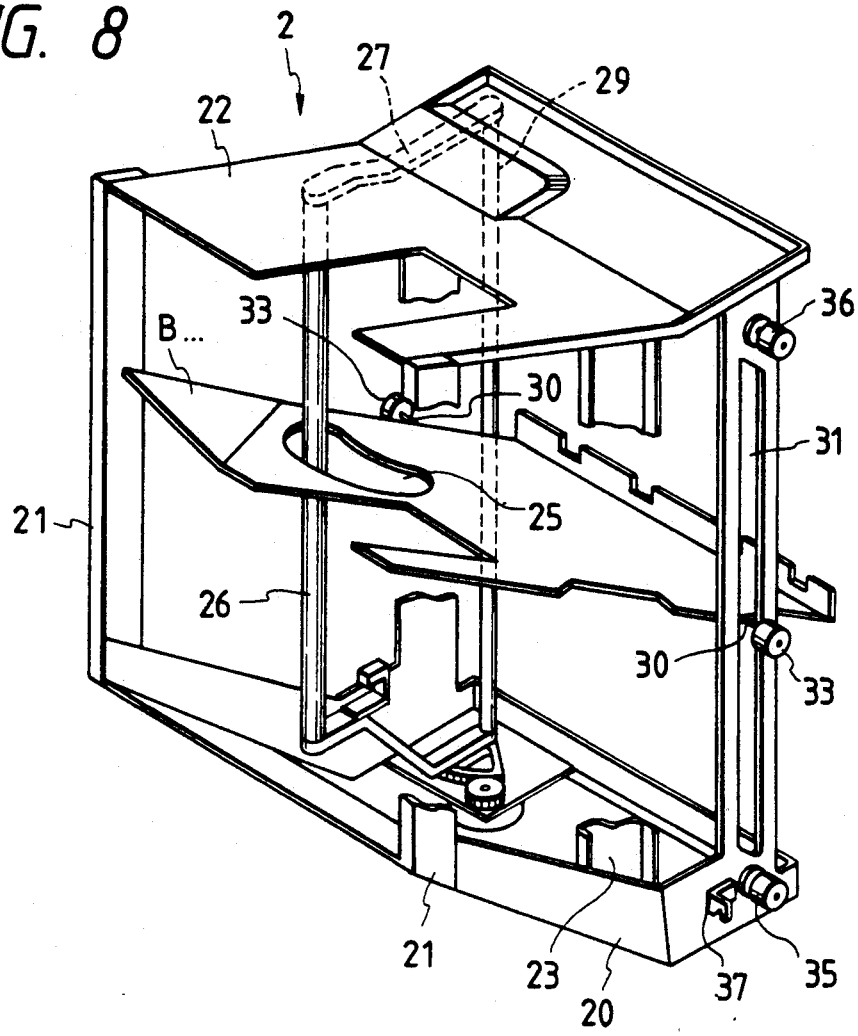
FIG. 8 is a perspective view of a bin unit.

As shown in FIGS. 6 to 8, the bin unit 2 has a pair of bin support plates 20 in front and back, constituting a frame structure. At the front ends of said bin support plates 20 there are mounted bin sliders 21, and a bin cover 22 is fixed to said bin support plates 20 and bin sliders 21. A bin alignment reference member 23 extends from said bin cover 22 to a bin support plate 20. Also in a cutout hole 25 formed in each of all the bins B there extends an alignment rod 26, which is supported, at the upper and lower ends, by a pair of support members 27 in turn supported by a shaft 29 and which can be rotated about said shaft 29. The sheets P housed in the bins B are pushed by the rotation of said alignment rod 26 to the alignment reference member 23 and thus aligned.

Figure 9:
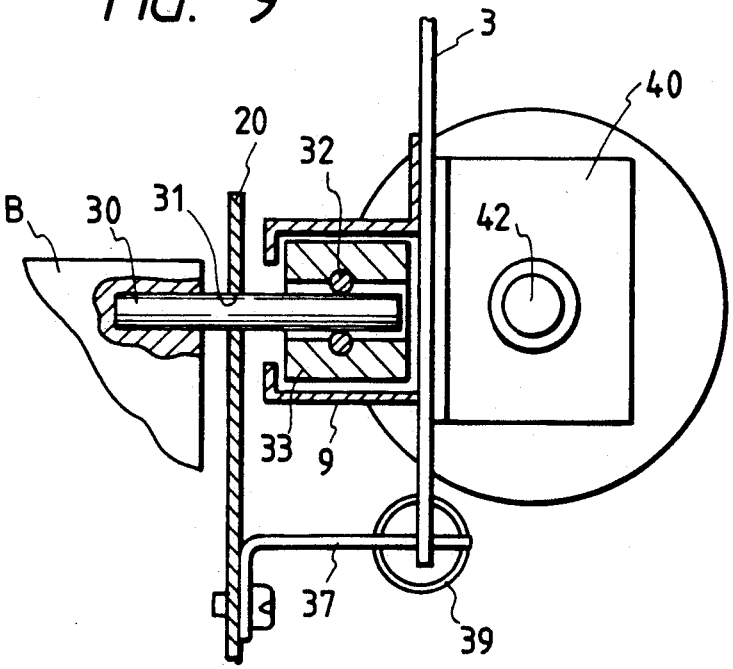
FIG. 9 is a partial cross-sectional plan view of a lead cam and a trunnion.

Each bin B in the bin unit 2 is slidably supported, at both sides of the free end, by one of comb-tooth grooves (not shown) formed on the bin sliders 21. Also on both sides of the other end of each bin there are fixed pins 30 as shown in FIG. 9. Said pins 30 respectively pass through slits 31 formed on the bin support plates 20 at left and right, and trunnions 33 are rotatably mounted on the outside, with o-rings 32 as cushion members.

Said trunnions 33 of the bins B are fitted in said guide rail 9 in stacked manner, whereby the lowermost trunnion 33 is in contact with a lower guide roller 35 rotatably supported by the bin support plate 20, while the uppermost trunnion is in contact with an upper guide roller 36 rotatably supported by said bin support plate 20, so that the bins B are supported with an interval equal to the external diameter of said trunnion 33.

As shown in FIG. 4, the bin unit 2 can vertically move along the guide rails 9, with said upper guide rollers 36 and lower guide rollers 35 fitted in the guide rails 9. Between members 37 fixed to the bin unit 2 and the side plates 3 there are provided tension springs 39 for pulling the bin unit 2 upwards.

Figure 10:
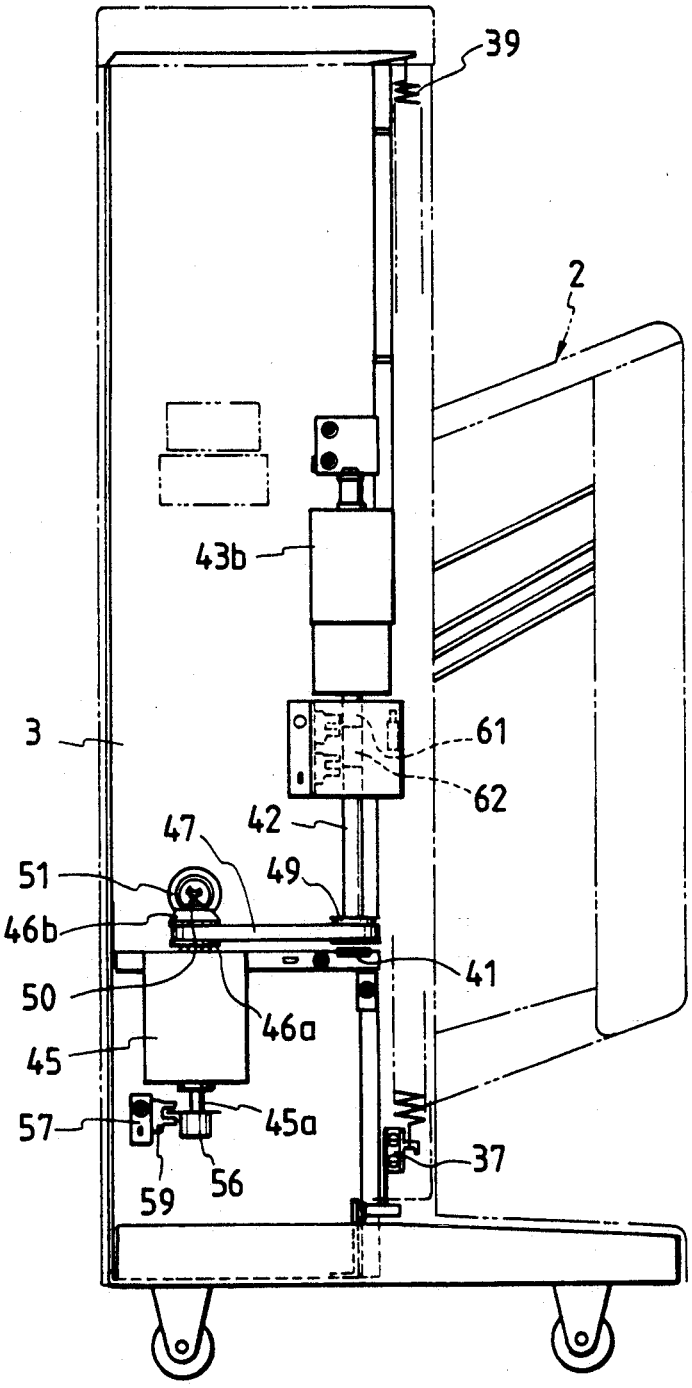
FIG. 10 is a lateral cross-sectional view of the apparatus shown in FIG. 4, seen from the opposite side.

In a position corresponding to the lower discharge rollers 16 supported by the side plates 3. there are provided cam shaft holders 40 as shown in FIGS. 6 and 10, and lead cam shafts 42 rotatably supported by bearings 41 extend between said cam shaft holders 40 and the aforementioned base member 5. At the upper ends of said lead cam shafts 42 positioned at left and right, there are provided lead cams (spiral cam means) **43*a*, 43*b*** having spiral cam faces.

Figure 14:
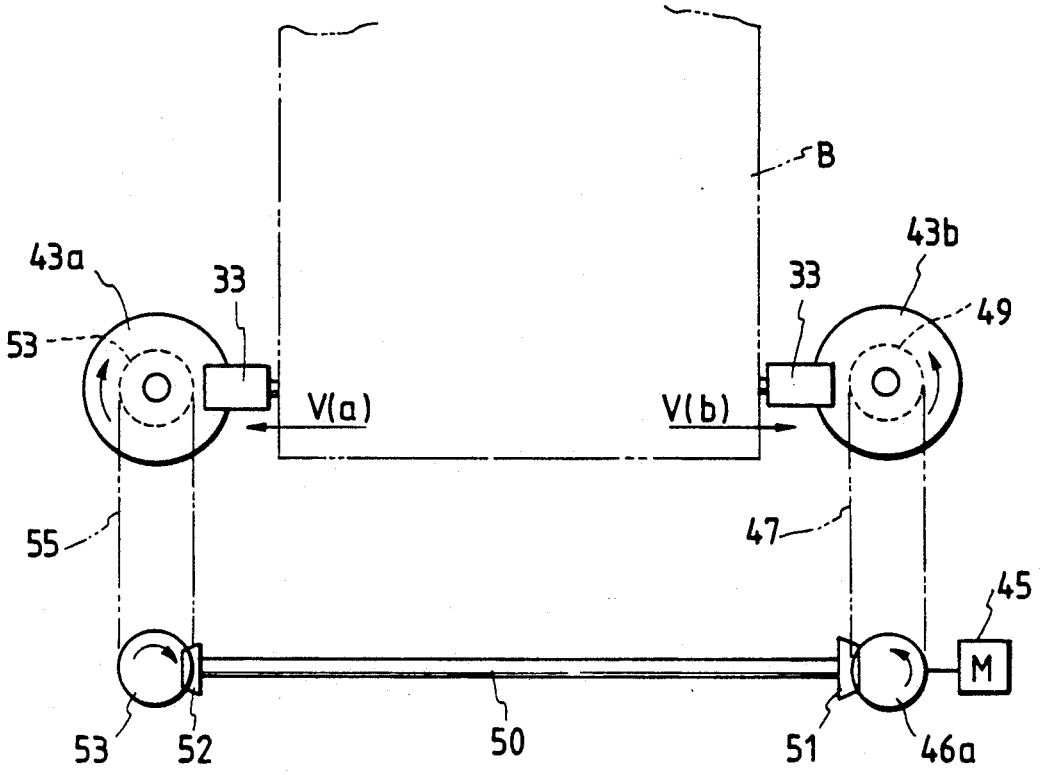
FIG. 14 is a plan view of a driving system for the lead cams.

As shown in FIGS. 10 and 14, a reversible motor 45 is mounted on a side plate 3, and the output shaft **45*a* of said motor is provided with a pulley 46*a* integral with a bevel gear 46*b*. Said pulley 46*a* is linked, by a belt 47, to a pulley 49 of the lead cam shaft 42 of the lead cam 43*b*. Also said bevel gear 46*b* meshes with a bevel gear 51 mounted on an end of a shaft 50, and a bevel gear 52 mounted on the other end thereof meshes with a bevel gear (not shown) integral with a pulley 53, linked by a belt 55 with a pulley 53 fixed to the lead cam shaft 42 of the other lead cam 43*a*, as shown in FIG. 14. In the above-explained drive system, the forward or reverse rotation of the motor 45 causes rotation of the lead cams 43*a*, 43*b* in a direction indicated by arrows or in the opposite direction in FIG. 14**.

On the other end (lower end in FIG. 10) of the motor 45, there is mounted a clock disk 56, which enables to read the revolution of the motor 45 or the lead cams **43*a*, 43*b*, in cooperation with an interruptor 59 supported by a sensor holder 57 on a side plate 3, thereby said revolution can be arbitrarily controlled by a lead cam control circuit of the sorter 1**.

Figure 11:
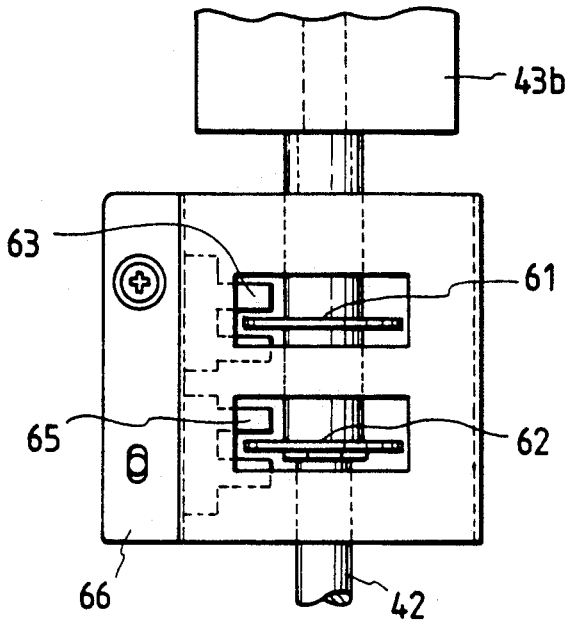
FIG. 11 is a lateral view of a flag portion of the lead cam.
Figure 12:
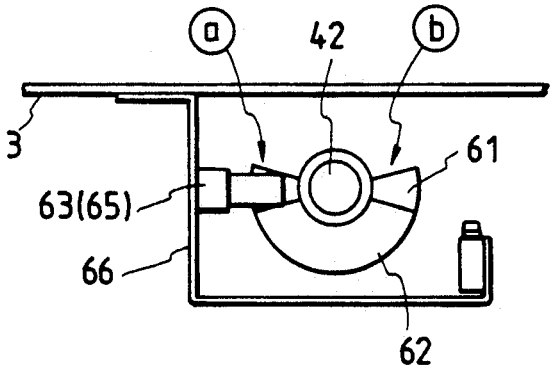
FIG. 12 is a plan view of the same.

As shown in FIG. 10, on the cam shaft 42 below the lead cam **43*b* there are mounted flags 61, 62 for detecting the position of the lead cams 43*a*, 43*b*. As shown in magnified views in FIGS. 11 and 12, a holder 66 fixed on the side plate 3 supports interruptors 63, 65 for reading said flags 61, 62**.

Said interruptors 63, 65 have a same flag angle but are different in phase by a predetermined amount. The on-off operations of two interruptors 63, 65 with different phases allow to identify whether the bins B are in the home position in the ascending direction or that in the descending direction, as will be explained later.

Each of the lead cams **43*a*, 43*b* has a parallel portion over about 180° as will be explained later, and the phase difference between the flags 61, 62 is determined in relation to said parallel portion. More specifically said phase different is selected at about 30°, and the positions of the lead cams 43*a*, 43*b* are identified by the on-off operations of said interruptors 63, 65 resulting from the angular difference of said flags 61, 62**.

In the following there will be explained the movement of the bin B, determined by the form of the lead cams 43a, 43b and the trunnion (bin roller) 33 engaging therewith.

Figure 13A:
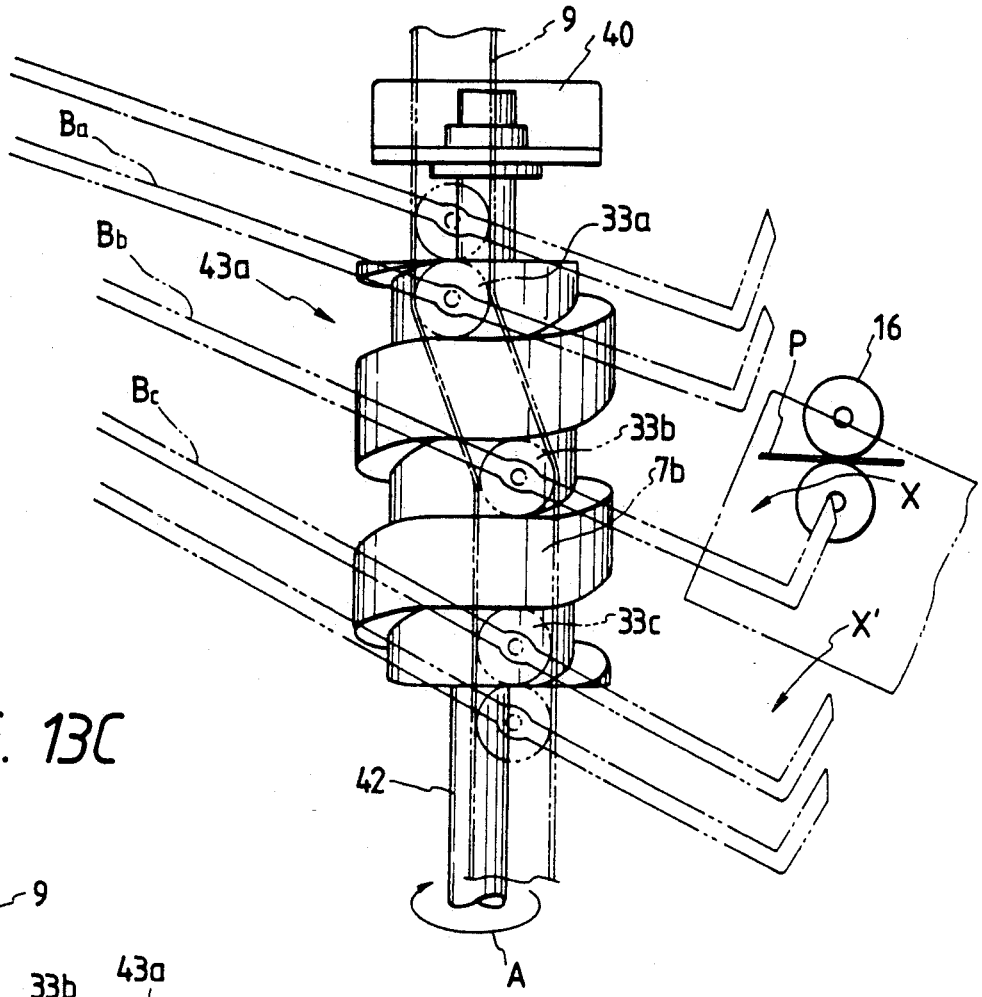
FIGS. 13A to 13D are lateral views showing the relation between the lead cam and the bins.
Figure 13C:
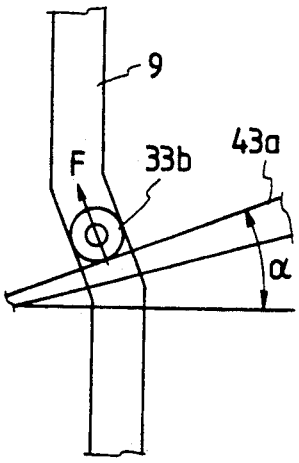
Figure 13B:
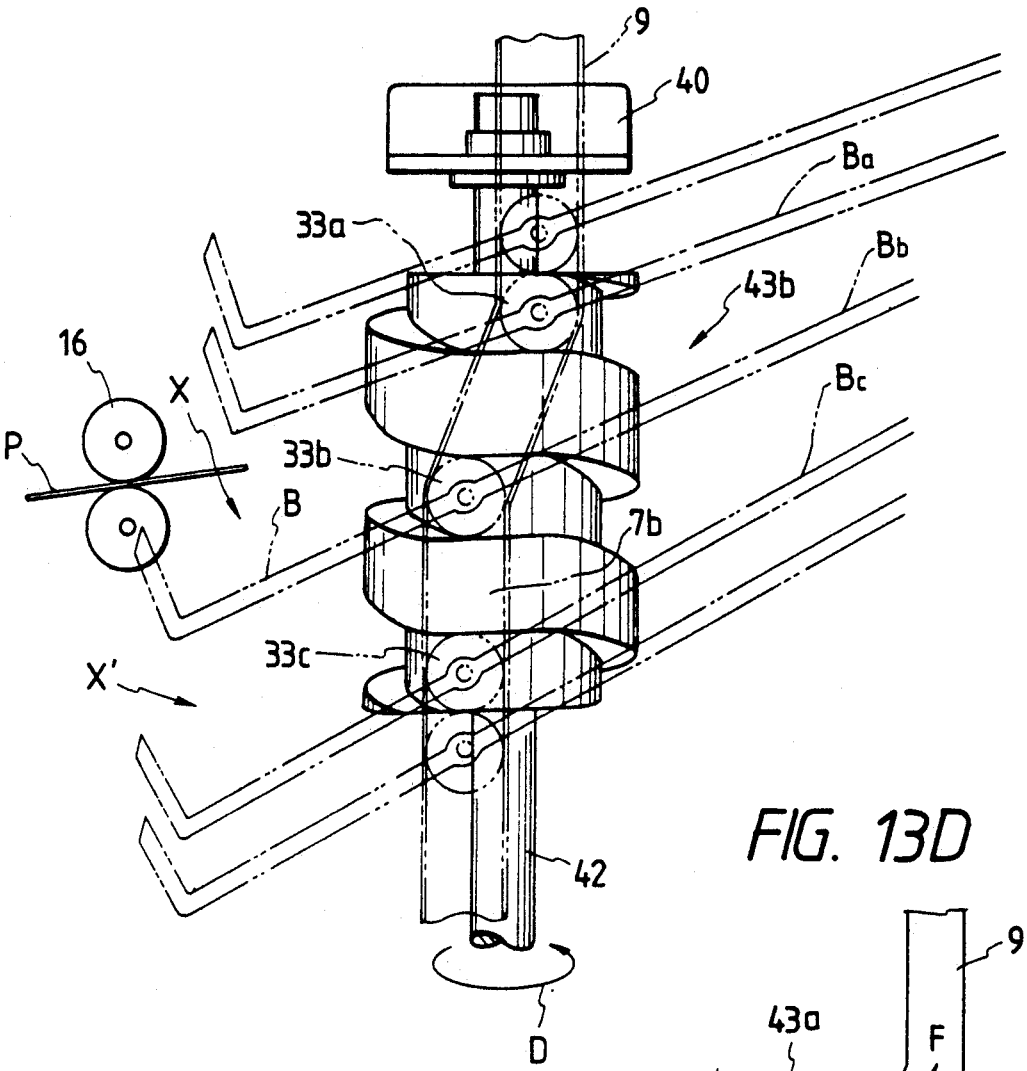
Figure 13D:
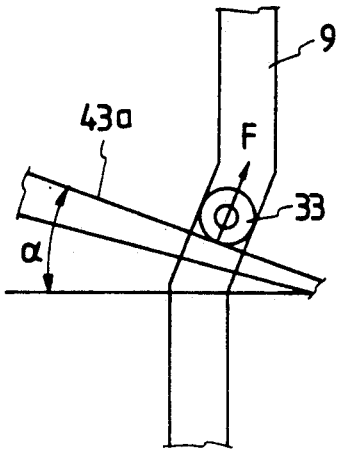

FIG. 13A shows the relation among the left lead cam 43a, trunnions 33 and bins B, while FIG. 13B shows a similar relation of the right lead cam 43b, and FIG. 14 is a plan view of the driving system for the lead cams 43a, 43b.

As shown in these drawings, the lead cams 43a, 43b of the present embodiment have mutually opposite directions of spiral so as to be rotated in mutually opposite directions, thereby constituting a mirror image relationship. Also in the present embodiment the spaces of the bins B are widened in two widening positions X, X', in order to accept a stapling mechanism 67 that can be introduced into and retracted from the bin B. For the sorting only, said spaces may be widened only in position X at which the sheet P is introduced.

When the lead cams 43a, 43b are rotated by the motor 45 in the direction of arrow or in the opposite direction, the trunnions 33 are pressed in the grooves of the lead cams 43a, 43b and ascent or descend, being guided by the guide rails 9. A bent portion, formed in a part of the guide rail 9 shown in FIG. 13A or 13B, is to displace the bin B in the sheet moving direction in cooperation with the sheet stapling mechanism 67 provided in the sorter 1 of the present embodiment, and is not to limit the structure of the present invention.

Figure 1A:
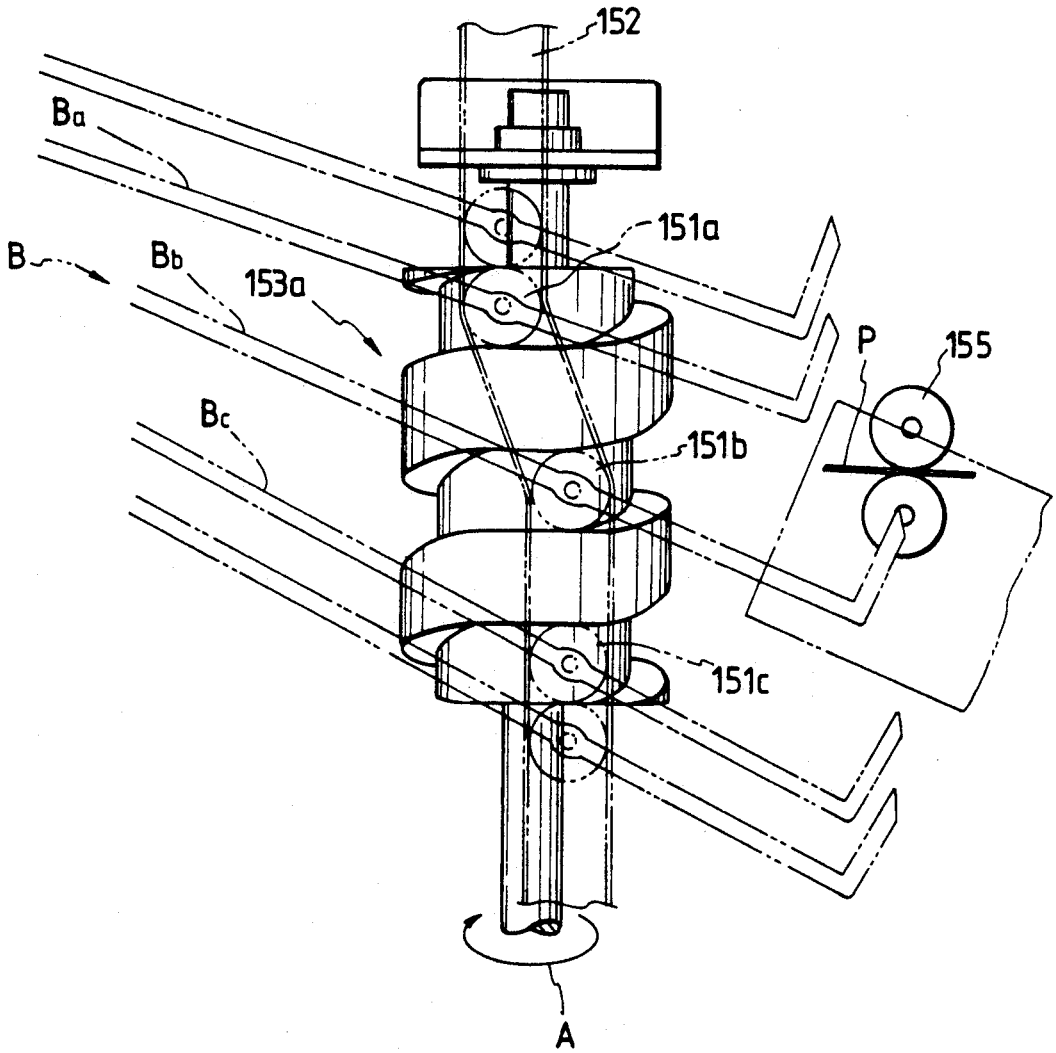
FIG. 1A PRIOR ART
FIGS. 1A and 1B are lateral views showing the relation between a lead cam and bins in a conventional movable bin sorter.
Figure 1B:
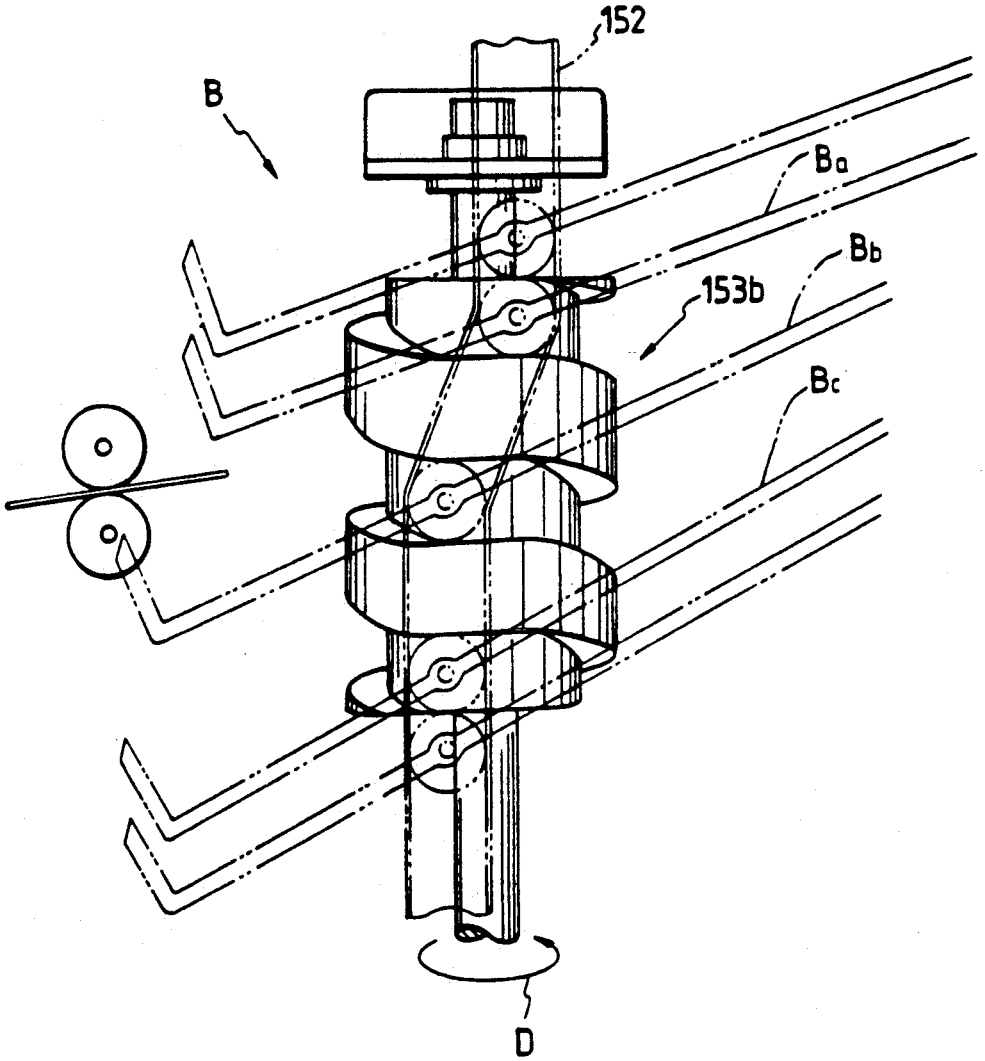
FIG. 1B PRIOR ART
Figure 2A:
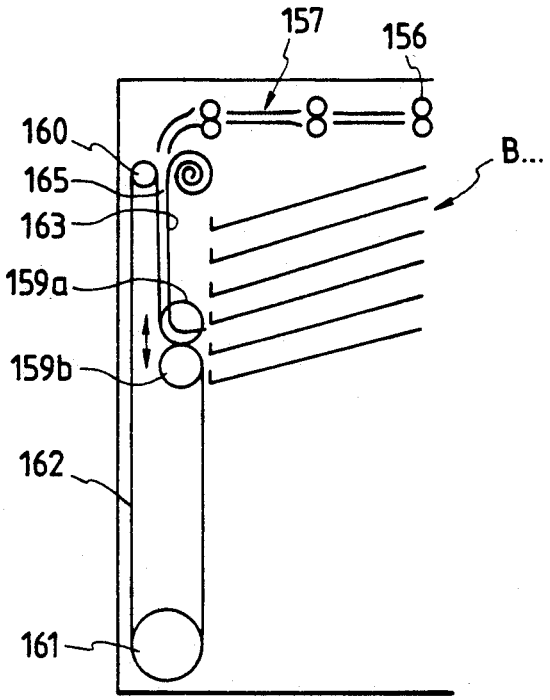
FIG. 2A PRIOR ART
FIGS. 2A and 2B are lateral views showing a principal part of conventional fixed bin sorters.
Figure 2B:
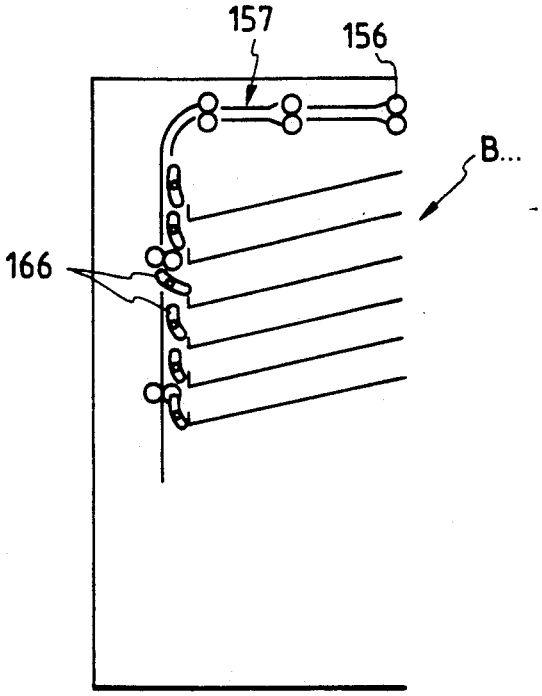
FIG. 2B PRIOR ART
Figure 3:
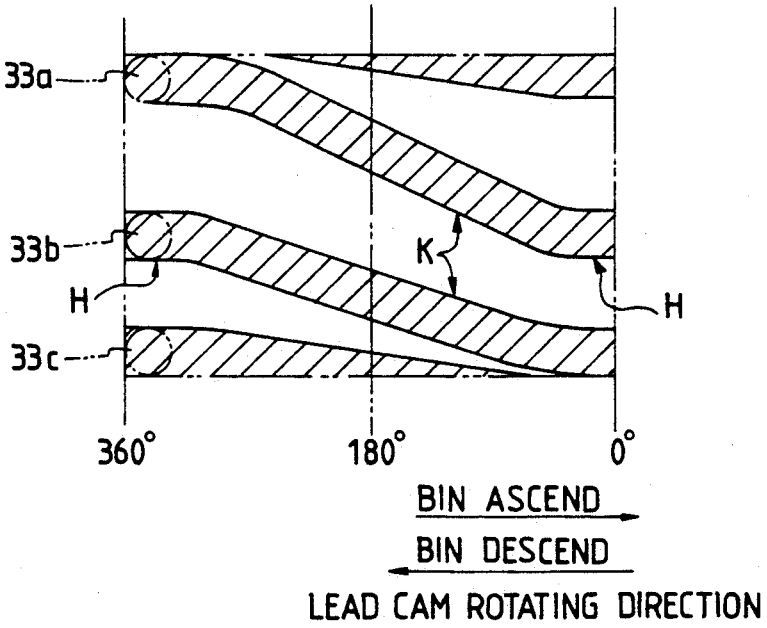
FIG. 3 PRIOR ART
FIG. 3 is a cam line chart of a conventional lead cam.
Figure 15:
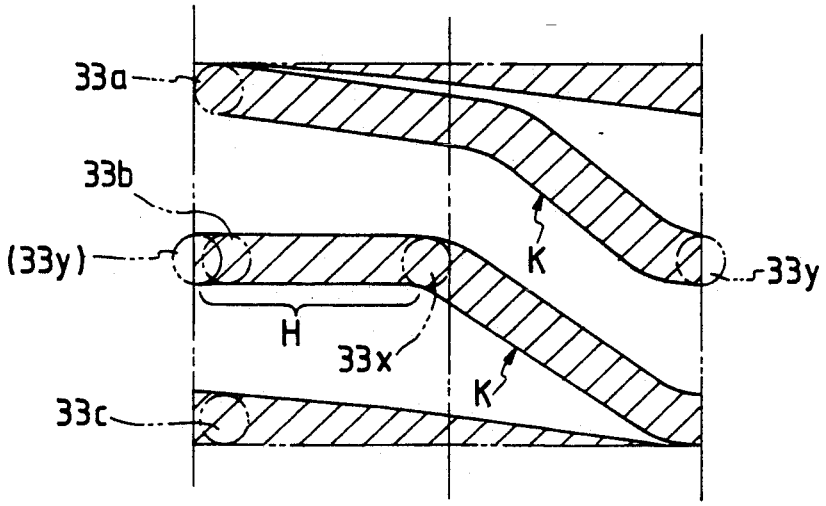
FIG. 15 is a cam line chart of the lead cam.

FIG. 15 is a cam line chart of the lead cam 43a of the present embodiment, while FIG. 3 is a cam line chart of a conventional lead cam, wherein hatched portions indicate cam grooves. Said cam line charts corresponds to the cams at the left side seen in the moving direction of the sheet P, and those of the other lead cam 43b are of mirror symmetry. Each of said cam line charts covers a range of 0° to 360°, and contains two cam lines.

The trunnions present in the grooves of the lead cam 43a are indicated by 33a, 33b, 33c. As shown in FIG. 15, the lead cam 43a of the present embodiment has a substantially parallel portion H which covers a range of about 180° in the present embodiment. In the above-explained cam line chart, the bins B move upwards when the lead cam 43a moves to right (with relative movement of the trunnions 33 to left), namely when the lead cam 43a shown in FIG. 14 rotates in the direction of arrow, and the bins B move downwards when the lead cam 43a moves to left (with relative movement of the trunnions 33 to right). Said parallel portion H corresponds to the sheet discharge position of the lead cam 43a, while inclined portions K correspond to shifting positions.

At the discharge of the sheet P from the lower discharge rollers 16 shown in FIG. 4, the lead cam 43a is set so that the sheet P meets the parallel portion H of the lead cam 43a. Consequently the home position is defined as 33x when the trunnions 33 ascend, or as 33y when the trunnions 33 descend. The phase difference between said home positions 33x and 33y is selected as 180° in the present embodiment, as shown in FIG. 15. The positions 33x, 33y of the lead cam 43a respectively correspond to flag areas (a) and (b) shown in FIG. 12.

In the present embodiment, the revolution $R_1$ (rpm) of the lead cam 43a can be represented by:

$$R_1 = \frac{60\theta}{2\pi t_1} \quad (1)$$

wherein 2 $\pi$ indicates a turn of the lead cam 43a or 43b, $\theta$ (rad) indicates the angular range of the parallel portion H, and $t_1$ is the time period required by the sheet P to pass through the lower discharge rollers 16.

Consequently the revolution of the lead cam 43, or the process speed, increases as the discharging time period of the sheet P decreases.

Then it is necessary to consider the time interval $t_2$ of the sheets P discharged in succession from the image forming apparatus. In order that the lead cam 43 can make a full turn in a period corresponding to the sum of the sheet discharge time and the sheet interval, the revolution $R_2$ (rpm) of the lead cam 43 in the remaining portion $(2\pi-\theta)$ (corresponding to the inclined portion of the cam) has to be:

$$R_2 = \frac{60(2\pi - \theta)}{2\pi t_2}. \quad (2)$$

Therefore, if the angular range $\theta$ of the parallel portion H of the lead cam 43 is so selected as to satisfy $R_1 = R_2$, the rotating speed of the lead cam 43 becomes theoretically same at the sheet discharge and at the interval of sheets, thereby enabling to introduce the sheets P into the bins B during continuous rotation of the lead cam 43. In this state a series of sheets P discharged from the image forming apparatus can be sorted during constant-speed rotation of the lead cam 43.

When the image forming apparatus is of a high speed, it may not be possible to maintain the constant-speed rotation of the cam 43 since the interval $t_2$ becomes very small. Even in such case, the lead cam 43 can still be in continuous rotation by two-speed control with $R_1$ and $R_2$. Consequently the apparatus of the present embodiment can reduce the noise level, as it is free from the impact noises in the conventional movable-bin sorter, generated by the inertia of the bin unit, associated with the start and stop of the lead cams in such sorter.

The present embodiment is further characterized by the high productivity, suitable for use in combination with a high-speed copying machine. More specifically, the angular range of the parallel portion H of the lead cams 43 may be suitable changed, for example to a value larger than 180°, so that the rotating angle of the lead cams 43 in the interval between sheets can be reduced. Thus the sorter can follow the operation of a copying machine of higher speed even with a considerably lower rotating speed of the lead cams 43.

Moreover, electric power consumption of the copying machine can be reduced since the bin unit 2 with a large mass need no longer on-off (start-stop) controlled.

In the following there will be explained a series of operations of introducing the sheet P from the image forming apparatus into the sorter 1, discharging said sheet P into a bin B and shifting said bin B.

At first, the sheet P discharged from the unrepresented image forming apparatus to which the sorter 1 (FIG. 4) is connected, is introduced through the entrance 10, guided through the entrance rollers 11 and the deflector 17, and discharged to the bin B. Said sheet P is discharged to the bins B through the upper discharge rollers 13 or the lower discharge rollers 16, respectively, in case of nonsorting mode or sorting mode.

The passing time of the sheet P and the interval between the sheets P are measured by sheet discharge signals from said image forming apparatus, and the measured information is transmitted by serial communication to a microcomputer (control unit 110 in FIG. 31) in the bin unit 2.

In case the detection time of a sheet P exceeds a predetermined value or a next sheet P cannot be detected with a predetermined time due to a failure in the sheet transportation, a jam signal as in the ordinary sensor is transmitted to the controller of the image forming apparatus, thereby stopping the function of the entire system.

Figure 31:
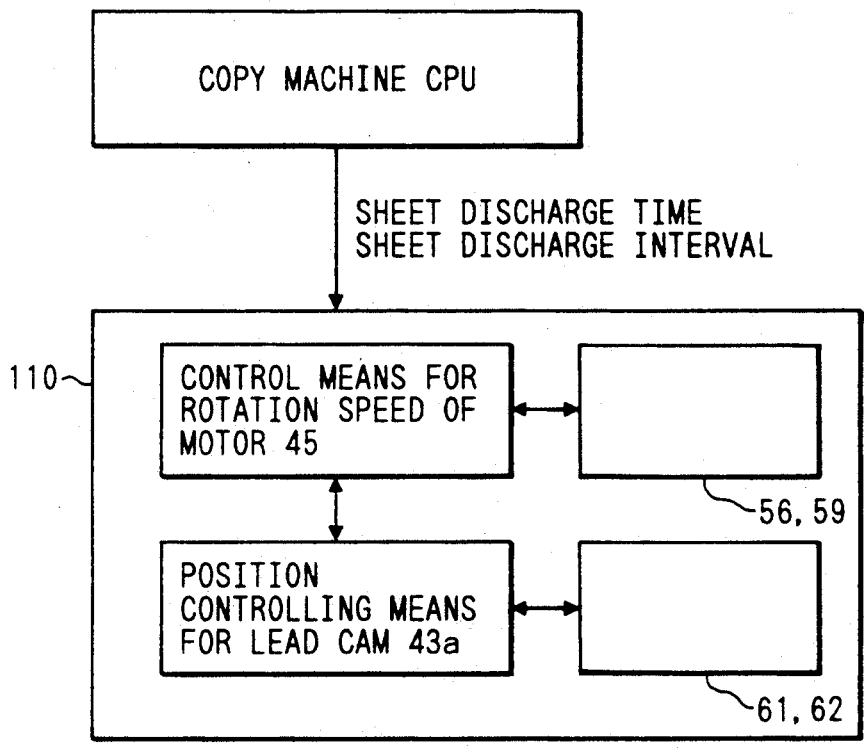
FIG. 31 is a block diagram of a copying machine.

In response to the measured information, the microcomputer 110 of the sorter 1 recognizes the discharge time (time of sheet discharge into the sorter 1) of the sheet and the interval of sheets, and accordingly controls the rotating speed and position of the lead cams 43 (cf. FIG. 31). The position control of said lead cams 43 is achieved by synchronizing the discharge of the sheet P into the bin B with the start of the parallel portion H of the lead cams 43.

As explained in the foregoing, the clock disk 56 (FIG. 10) provided on the output shaft 45*a* of the motor 45 for driving the lead cams 43 allows recognition of the speed of the lead cams 43 in cooperation with the interruptor 59, and the flags 61, 62 (FIGS. 11 and 12) provided on the lead cam shaft 42 allows to recognize the end positions of the parallel portion H of the lead cams 43.

For example, in the sorting operation with the ascending motion of the bin unit 2, the revolution of the lead cams 43 is so selected that the sheet discharge is started when the trunnions 33 of a bin B reach the home position 33*x* shown in FIG. 15 and the sheet discharge is completed during the movement of the trunnions 33 from the home position 33*x* to the position 33*y*.

Then the bin unit 2 is shifted during the movement from 33*y* to 33*z*. Since the interval of the sheets is already recognized from the aforementioned information, the rotation is so conducted that the trunnions 33 move from 33*y* to 33*z* in said interval. In this state the next bin B reaches the position 33*x* and receives the next sheet P. The above-explained procedure is repeated for every sheet.

In the sorting operation with the descending motion of the bin unit 2, the sheet discharge is started when the trunnions 33 of the bin for receiving the sheet P reach the position 33*y*, and is completed while the trunnions 33 move to the position 33*x*. The trunnions 33 move from 33*x* to 33*w* in the interval between the discharged sheets P, and the next bin B reaches the sheet receiving position 33*y*. The above-explained procedure is repeated for every sheet.

In the course of sheet discharge, the eventual variation in the process speed or in the sheet interval of the image forming apparatus is from time to time transmitted to the microcomputer of the bin unit 2, and the speed of the lead cams is constantly feedback controlled by the latest information.

Owing to the above-explained structure, the sorter 1 can not only cope with the difference in the sheet discharge time resulting from the difference in sheet size, but also achieve optimum lead cam control in various image forming apparatus with different process speeds and different sheet intervals. Consequently said sorter 1 can be stably connected to various copying machines. The above-mentioned sheet interval may be calculated in the image forming apparatus, or in the sorter.

In the following there will be explained a second embodiment of the present invention. The paired lead cams, positioned in a part of the bins in the first embodiment for achieving vertical movements of the bin unit 2 and the bins B thereof, may be replaced for example by a geneva conventionally employing as the vertical movement mechanism of the bins B. FIG. 16B shows a conventional geneva 72 which has a pair of notches 72*a* and is rendered rotatable in forward or reverse rotation, about a shaft 71.

Figure 16A:
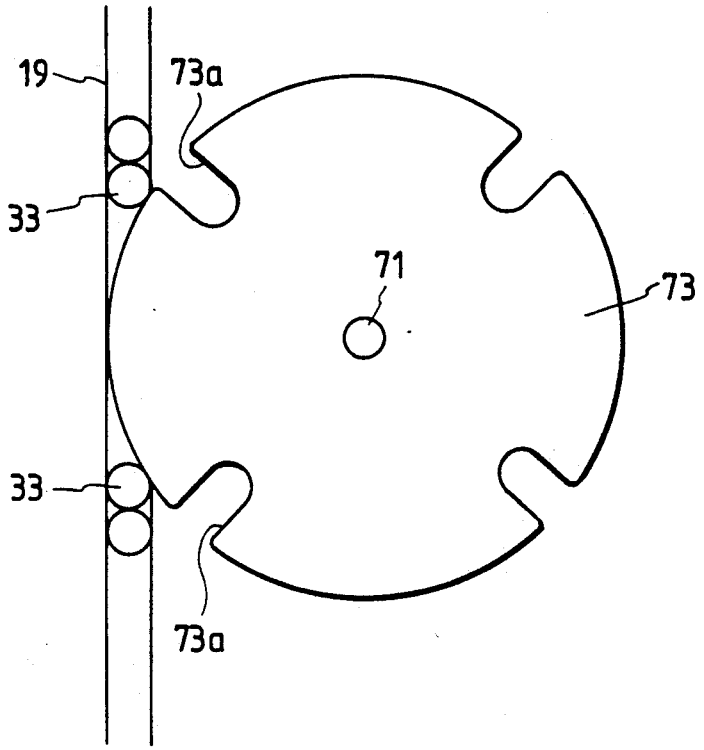
FIGS. 16A and 16B are lateral views of a geneva employed in a second embodiment of the present invention.
Figure 16B:
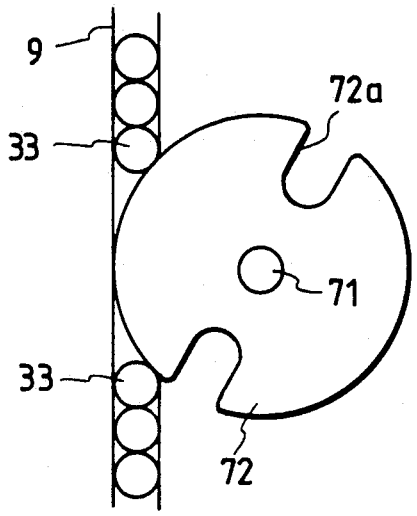
FIG. 16B PRIOR ART

Said geneva 72 can be replaced by a geneva 73 shown in FIG. 16A, with an increase number of notches 73*a*, whereby the revolution of the geneva 73 itself can be reduced to achieve noise reduction. Such geneva 73 has a larger diameter with the increase in the number of notches 73*a*.

Figure 17:
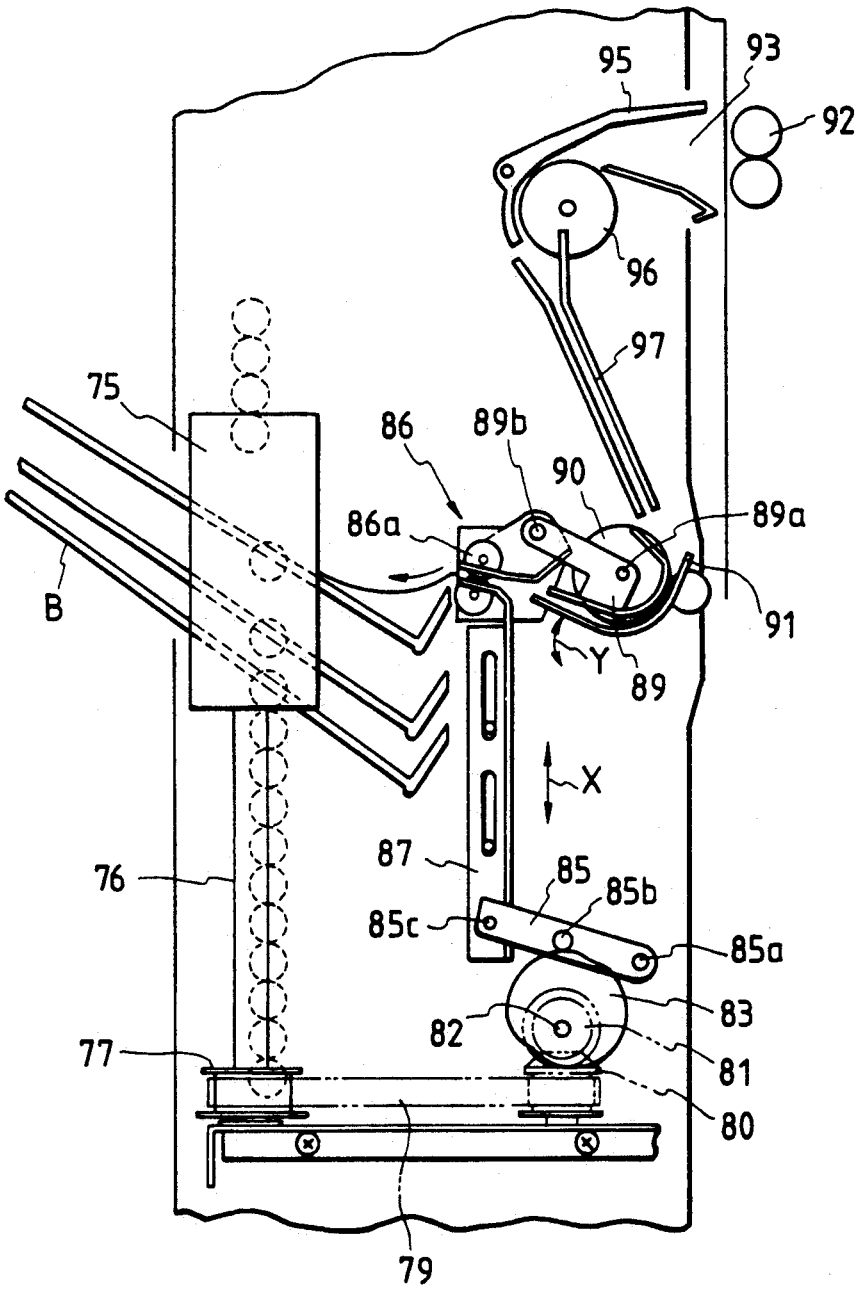
FIG. 17 is a lateral cross-sectional view of a sheet sorter constituting a third embodiment of the present invention.

In a third embodiment, a similar effect can be obtained by moving the lower discharge rollers in synchronization with the bins, instead of stopping the bins during the rotation of the lead cams, in order to maintain the bins and the lower discharge rollers in a relative stationary state during the sheet discharge. FIG. 17 shows such sorter. In this sorter, in order to precisely synchronize the discharge rollers with the bins, the vertical movement of the discharge rollers 86*a* is caused by the driving system of the lead cams 75 as will be explained later.

Referring to FIG. 17, at the lower end of the lead cam shaft 76 for the lead cam 75, there is fixed a lead cam pulley 77, which is linked, by a timing belt 79, with a transmission member 80 consisting of a pulley and an integral bevel gear. A bevel gear 81 meshing therewith is rotatably supported by a shaft 82. Other parts of the sorter are constructed same as in the foregoing embodiments.

In the present embodiment, the shaft 82 supports an eccentric cam 83 in a position different from that of the bevel gear 81. A vertically rotatable arm 85 is articulated, at the lower end portions thereof, with a shaft 85*a*, and rotates vertically, following the rotation of the eccentric cam 83, by the engagement of a rotatable pin 85*b*, provided in the middle of said arm 85, with the periphery of said eccentric cam 83.

The free end of said arm 85 is linked, by a shaft 85*c*, with the lower end of a link member 87, of which upper end is connected to a discharge roller unit 86 having paired discharge rollers 86*a*. Said link member 87 is rendered vertically movable, as indicated by an arrow X, by the rotation of the eccentric cam 83, thereby causing vertical movement of the discharge roller unit 86.

A transport roller 90 is rotatably supported by a shaft 89*a*, which is in turn supported by a rotating guide 89 having a guide plate 91. An end of said rotating guide 89 is articulated, by a shaft 89*b*, to said discharge roller unit 86. Thus, in synchronization with the vertical movement of the link member 87 and the discharge roller unit 86, the guide plate 91 of the rotating guide 89 vibrates as indicated by an arrow Y.

The sheet discharged by discharge rollers 92 of the image forming apparatus is introduced into the sorter 1 from an entrance 93, and is transported into a transport path 97 by a guide roller 96 and a guide plate 95. The sheet guided by said transport path 97 and the guide plate 91 is discharged into one of the bins B by the paired discharge rollers 86*a*.

In the above-explained sorter, rotation of the lead cam 75 causes rotation of the eccentric cam 83, thereby causing vibration of the arm 85 and vertical movement of the link member 87. Thus the discharge roller unit 86 and the discharge rollers 86*a* thereof move vertically in synchronization with the widening operation of the bins B.

Figure 18A:
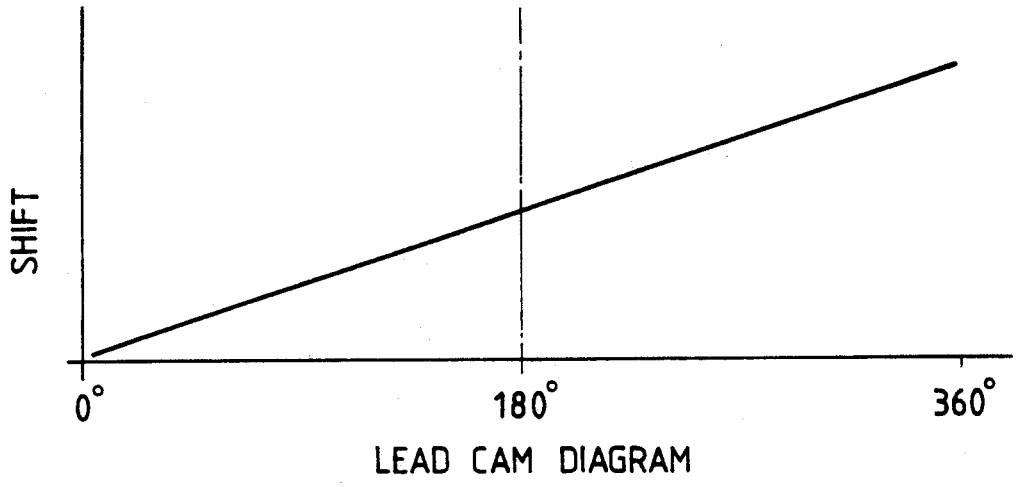
FIGS. 18A and 18B are cam line charts.
Figure 18B:
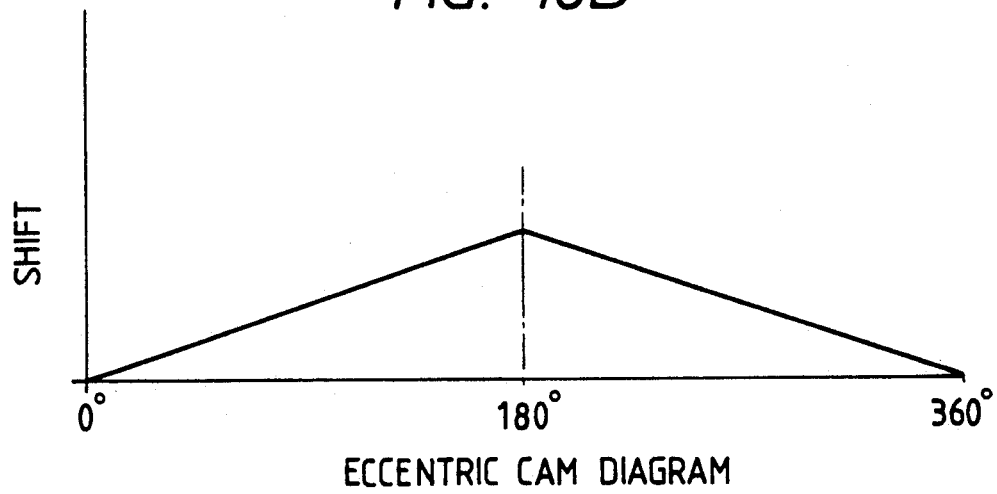

FIGS. 18A and 18B are cam line charts respectively of the lead cam 75 and the eccentric cam 83. In the illustrated example, the bin B and the discharge roller unit 86 are synchronized within a range of 0°–180°, in which the sheet is discharged into the bin B. FIG. 17 shows an angular position of 180°. In a range from 180° to 360°, the bin B continues ascent while the discharge roller unit 86 starts to descend toward the initial position at 0° for introducing the sheet into the next bin B, and is synchronized with the next bin B at the position 360°.

On the other hand, in case of descent of the bins B, a position of 180° is taken as the home position of the discharge roller unit 86 and the bins B. In this case the discharge is executed while the bin B and the discharge roller unit 86 are synchronized in a range from 180° to 0°, and said unit 86 is matched with the next upper bin B in a range from 360° to 180°.

The above-explained structure allows to discharge the sheet in the course of rotation of the lead cams 75 by vertically moving the discharge roller unit 86 in synchronization with the bin B moving along the inclined portion of the lead cams 75, instead of forming the parallel (horizontal) portion in said lead cams 75. Therefore the sheet sorting is rendered possible without repeating stoppage and start of the lead cams 75, as in the foregoing embodiments.

The structure shown in FIG. 17, when connected to an apparatus with a short sheet interval such as a high-speed copying machine, can also achieve sheet sorting with a revolution of the lead cams 75 considerably lower than that of the conventional sorter, thereby enabling a higher process speed in the copying machine and noise reduction in the sorter.

In the foregoing description relating to FIGS. 18A and 18B, it is assumed that the lead cam 75 and the discharge roller unit 86 are synchronized over an angular range of 180°, but it is to be understood that this value is variable, similarly as the angular range of the parallel portion of the lead cams in the foregoing embodiments. In fact said value can be suitably selected according to the speed and interval of the sheets and does not limit the structure of the present invention.

In the following there will be explained a fourth embodiment of the present invention with reference to FIG. 19.

Figure 19:
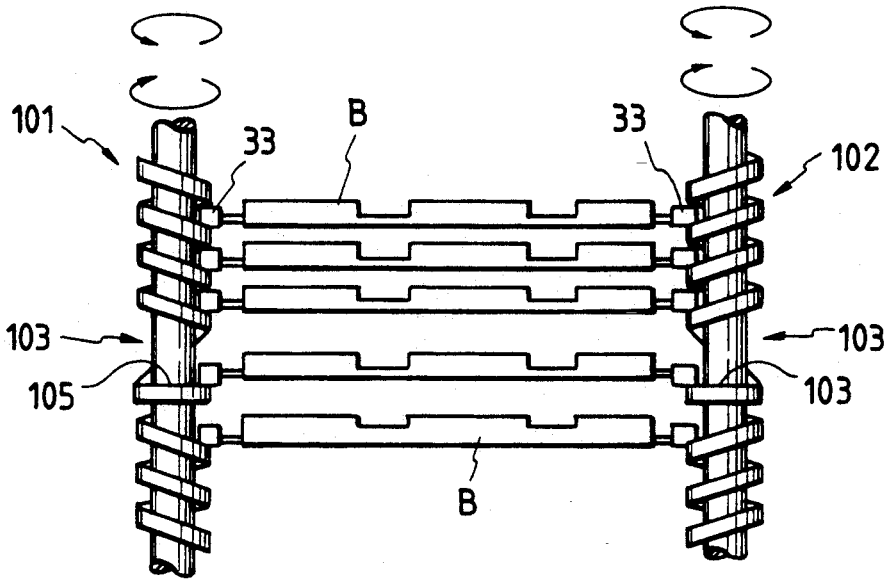
FIG. 19 is an elevation view of spiral cams and bins in a fourth embodiment of the present invention.

The paired lead cams 43 (75), provided in a part of the bins in the 1st and 3rd embodiments for effecting the vertical movement of the bin unit 2 and the bins B, are replaced by spiral cams 101, 102 of screw shape as shown in FIG. 19.

Each of said spiral cams 101, 102 has a sheet discharge position 103 where the screw pitch is widened and a parallel portion 105 positioned immediately below said discharge position 103. The winding directions of said cams 101, 102 are mutually opposite, constituting a mirror image relationship. Said spiral cams 101, 102 engage with the trunnions 33 of the bins B, which are thus moved upwards or downwards by the rotation of said cams in either direction.

Figure 20:
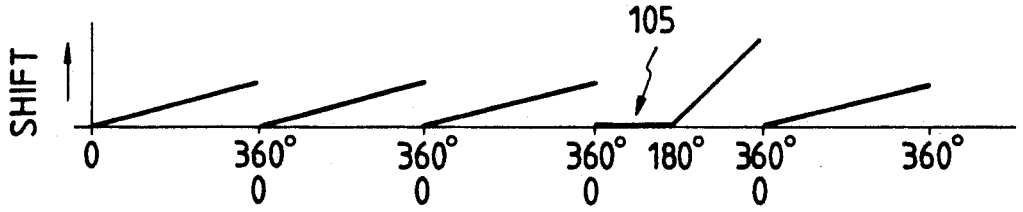
FIG. 20 is a cam line chart therefor.

The above mentioned parallel portion 105 is selected as a predetermined angular range, enabling sheet discharge in the course of rotation of the spiral cams 101, 102 at a constant revolution. The sheet sorting operation as in the 1st and 3rd embodiments can be achieved by giving a certain angle to the cam groove other than said parallel portion 105. FIG. 20 is a cam line chart of the spiral cam 102, wherein 105 indicates the parallel portion, corresponding to the sheet discharge position 103 to the bin B.

Figure 21:
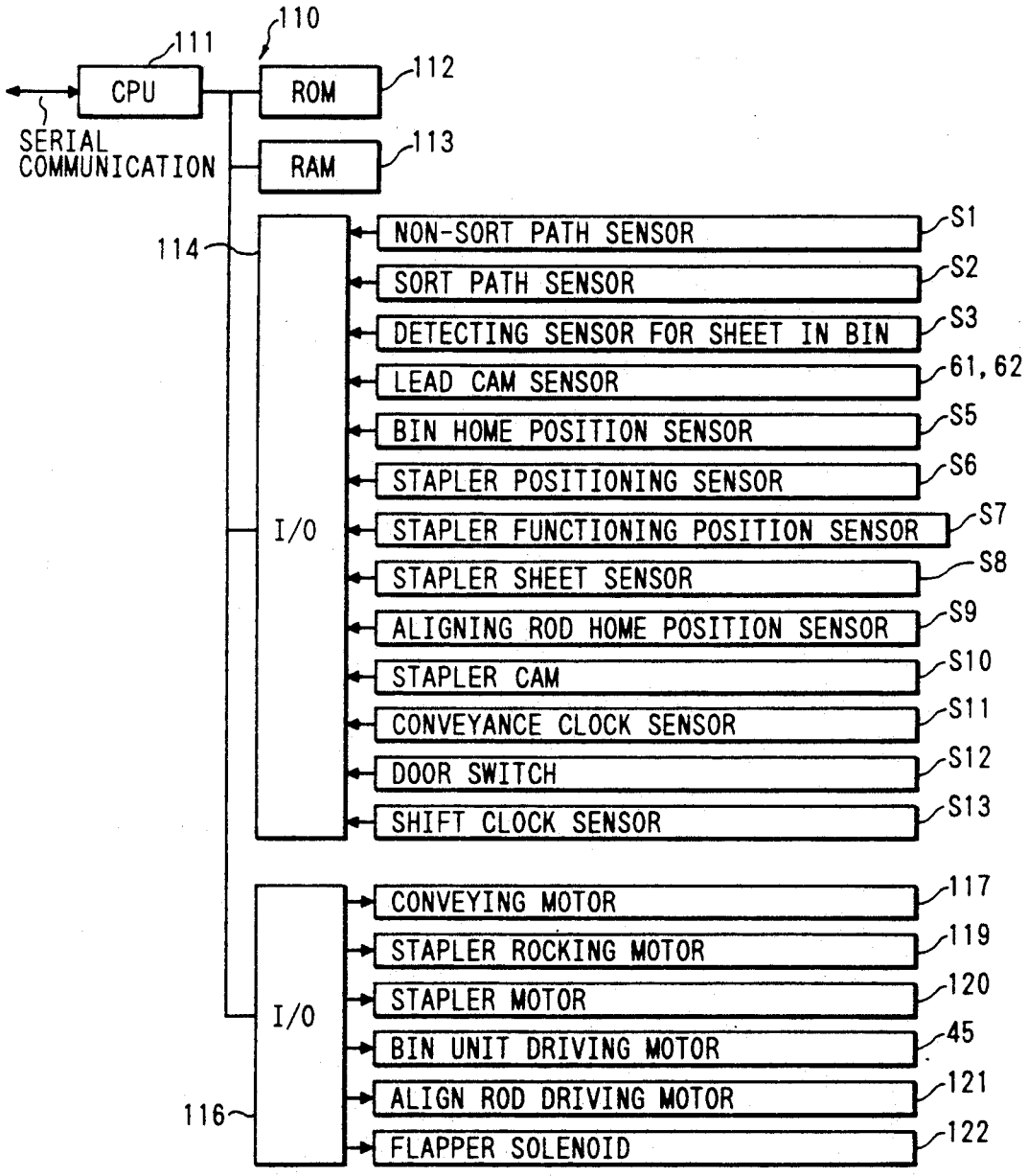
FIG. 21 is a block diagram of an example of control device to be employed in the sheet sorter of the present invention.

The sorter 1 shown in FIG. 4 has a controller 110 provided, as shown in FIG. 21, with a central processing unit (CPU) 111, a read-only memory (ROM) 112, a random access memory (RAM) 113, an input port 114, an output port 116, etc.

The ROM 112 stores a control program, and the RAM 113 stores input data and work data. The input port 114 is connected to various sensors such as a non-sort path sensor S1 and various switches, while the output port 116 is connected to various loads such as a transport motor 17 for driving the entrance rollers 11 and the lower discharge rollers 16, and the CPU 111 controls various parts according to the control program stored in the ROM 112. The CPU 111 is also provided with a serial interface and effects serial communication with the CPU for example of the main body of the copying machine, thereby controlling the various parts according to the signals from said main body.

In the following there will be explained the function of the present embodiment, with reference to flow charts shown in FIGS. 22 to 28.

Figure 22:
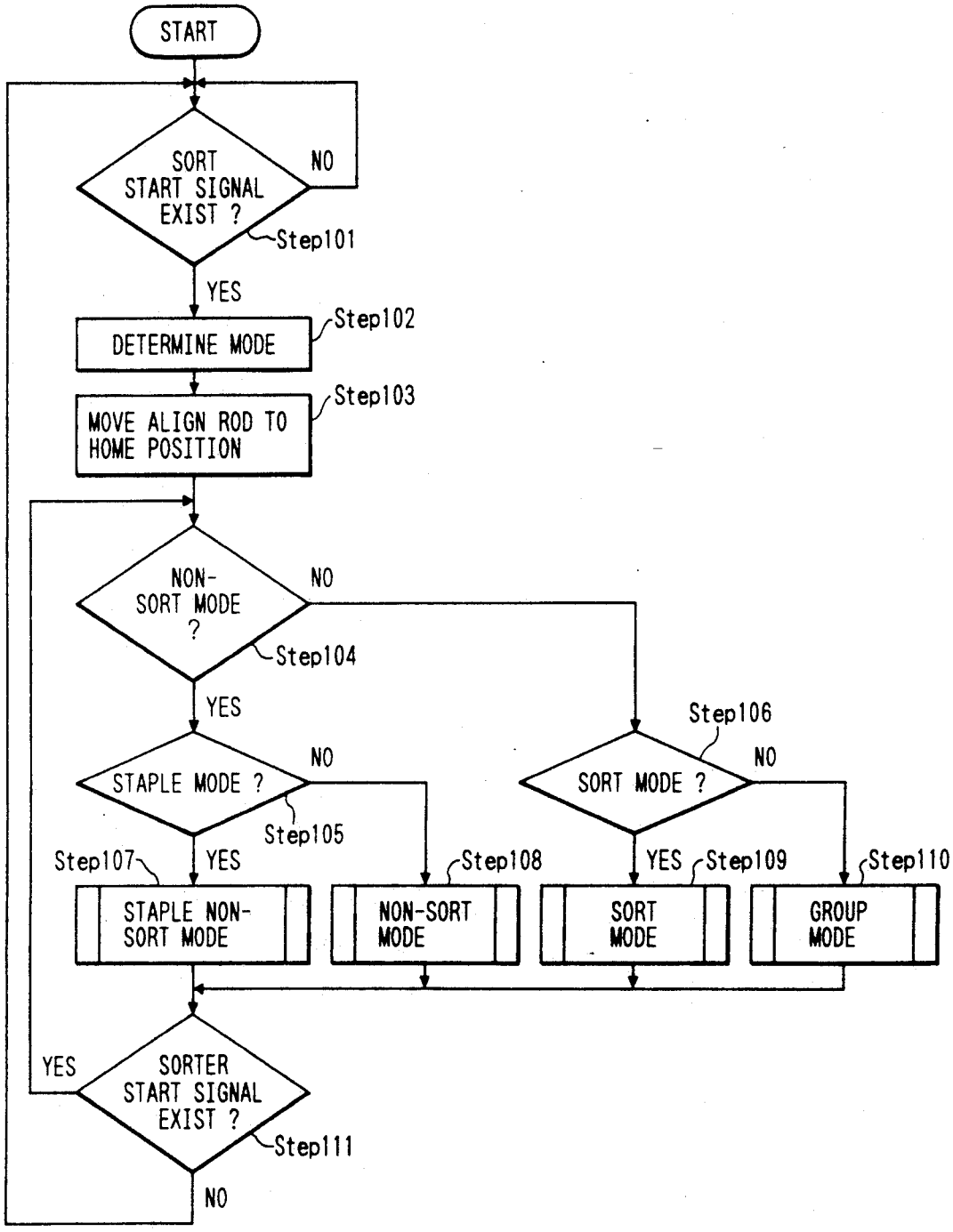

At first referring to FIG. 22, when the copying operation is started by the depression of a copy start key of the main body of the copying machine, a sorter start signal is sent by a serial signal from the main body of the copying machine. Upon reception of said signal by the sorter 1 (step 101), a step 102 determines the operation mode of a job until the sorter start signal is terminated, and mode data are stored in the RAM 113. Then the alignment rod 26 is returned to the home position for detecting the position thereof (step 103).

Then various units are operated according to the mode determined in the step 102. More specifically, a step 104 discriminates whether the non-sorting mode has been selected, and, if selected, a step 105 discriminates whether stapling has been instructed, and the sequence proceeds to the staple non-sort mode (step 107) if the stapling is instructed, or to the non-sort mode (step 108) if the stapling is not instructed. On the other hand, if the step 104 discriminates that the non-sort mode has not been selected, a step 106 discriminates whether the sorting mode has been selected. The sequence proceeds to a step 109 if the sorting mode is selected, or to a step 110 for group mode if the sorting mode is not selected. After the completion of operation in one of the above-mentioned modes, the sequence proceeds to a step 111 for discriminating whether the sorter start signal is still present, namely whether a job has been completed. If the sorter start signal is present, indicating that a job has not been completed, the sequence returns to the step 104. On the other hand, if the sorter start signal is absent, the completion of a job is identified and the sequence returns to the initial step 101.

Figure 23:
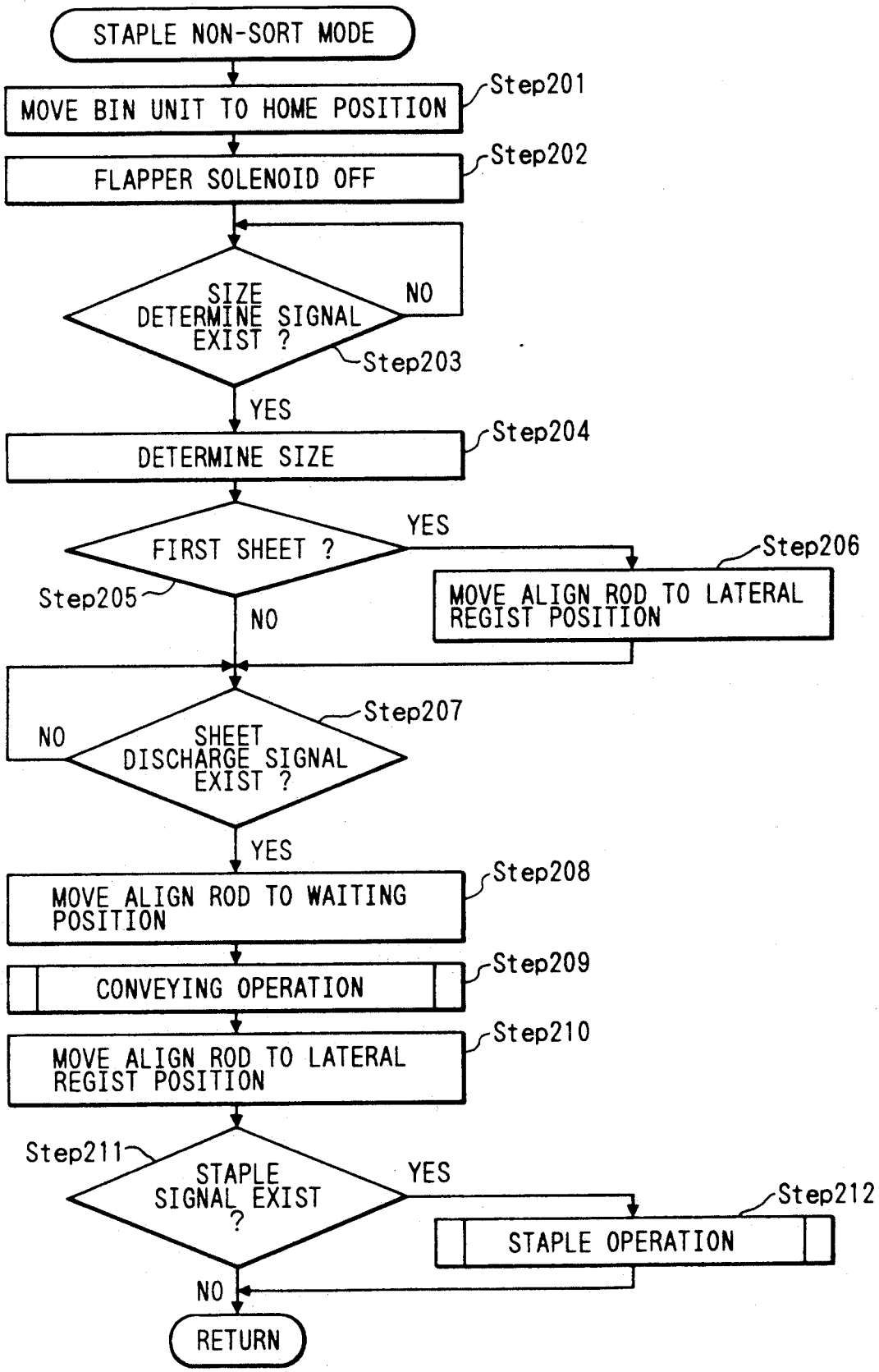

In the following there will be explained the function in the staple non-sort mode with reference to FIG. 23.

In said mode the bin unit 9 is at the home position, and a step 201 moves the bin unit 9 to the home position. The stapling mechanism 67 is unable to staple the sheets placed on the bin cover 22, but is designed to staple the sheets P stored in the bin B. It is therefore necessary to introduce the sheets P into the bins B in case the stapling mode is selected, even if the sorting operation is not conducted. For this reason the flapper solenoid 122 is turned off, thereby selecting the lower discharge rollers 16 (step 202). Thereafter the reception of a size determination signal is awaited (step 203), and, upon reception thereof, the size data sent from the main body of the copying machine are stored in the RAM 113 (step 204). If the sheet discharged from the main body is the 1st sheet (step 205), the alignment rod 26, which should have been placed at the home position, is moved to an alignment position 26*a* (step 206). If the step 205 identifies that the sheet is not the first one, or after the movement of the alignment rod 26 to the alignment position 26*a* in the step 206, the sequence proceeds to a step 207 for awaiting a sheet discharge signal from the main body. Upon reception thereof, the alignment rod 26 is moved from the alignment position 26*a* to a standby position 43*b* (step 208). Then the sheet is introduced into the bin B (step 209), and the alignment rod 26 is moved to the alignment position 26*a* for aligning the sheet (step 210). Then a step 211 discriminates the presence of a staple signal, and, if present, a stapling operation is conducted (step 211), or, if absent, the sequence returns to the main routine.

Figure 24:
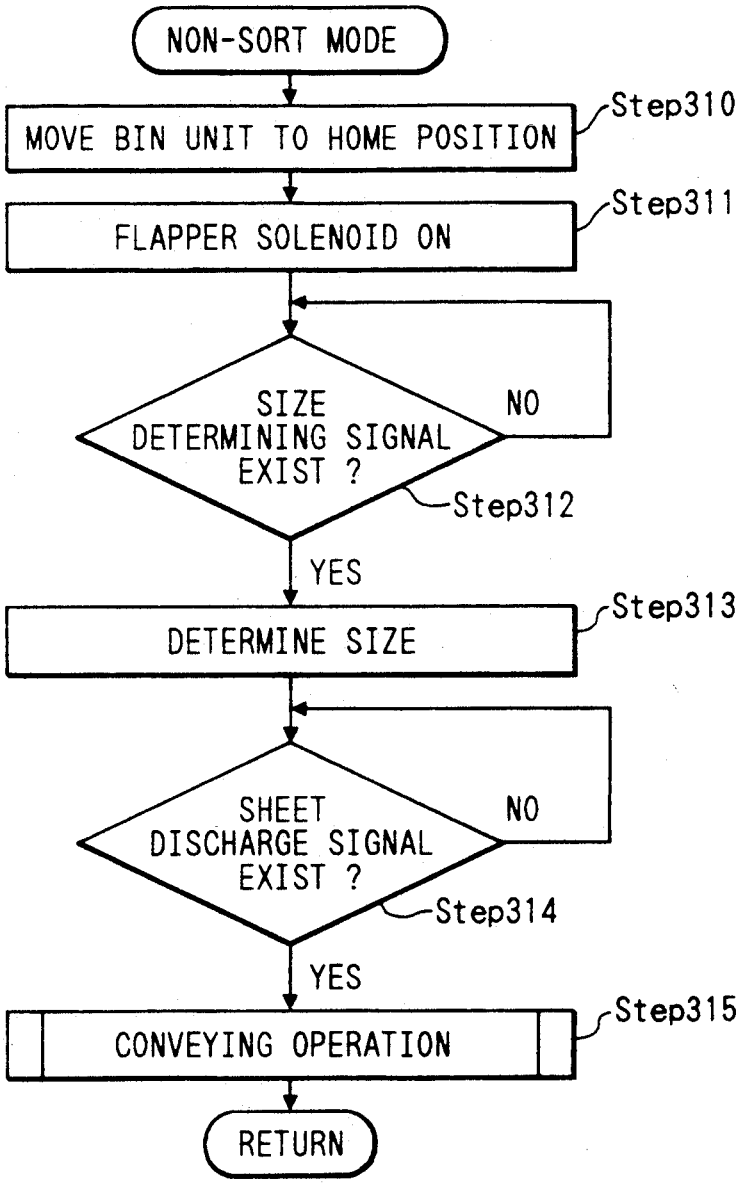

In the following there will be explained the function in the non-sort mode, with reference to FIG. 24.

In the non-sort mode, the sheets are discharged onto the bin cover 22. Therefore the bin unit 2 is moved to the lowermost home position (step 310), and the flapper solenoid 122 is energized to discharge the sheets from the upper discharge rollers 15 (step 311). Then, upon reception of a size determination signal (step 312), the sheet size is determined. Then a step 314 awaits a sheet discharge signal from the main body, and, upon reception thereof, a step 315 executes sheet discharge on the bin cover 22 and the sequence returns to the main routine.

Figure 25:
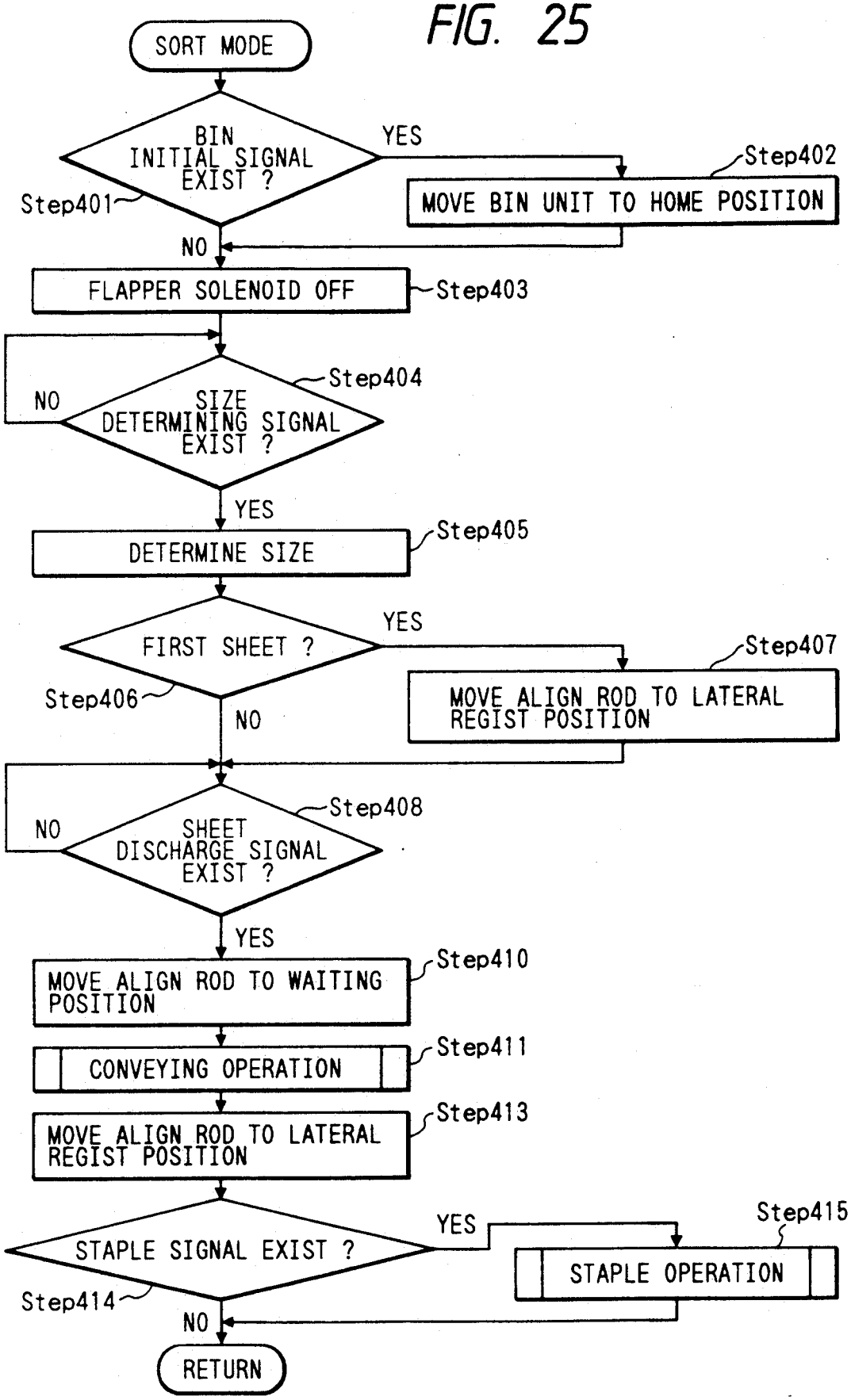

In the following there will be explained the function in the sorting mode, with reference to FIG. 25.

At first there is discriminated whether a bin initial signal for returning the bin unit 2 to the home position is received from the main body (step 401), and, if received, the bin unit 2 is moved to the home position (step 402). Then the flapper solenoid 122 is turned off for selecting the lower discharge rollers 16 (step 403). Then, upon reception of the size determination signal (step 404), the size is determined (step 405). Then there is discriminated whether said size determination is for the 1st sheet (step 406), and, if for the 1st sheet, the alignment rod 26 is moved to the alignment position 26*a* (step 407). Subsequently, upon reception of the sheet discharge signal from the main body (step 408), the alignment rod 26 is moved to the standby position 26*b* (step 410) Then the sheet is discharged into the bin B (step 411), and the alignment rod 26 is moved to the alignment position (step 413). A subsequent step 414 discriminates whether the stapling signal is present, then the stapling operation is conducted only when said signal is present (step 415), and the sequence returns to the main routine.

The movement of the bins B in the sorting operation will be explained later.

Figure 26:
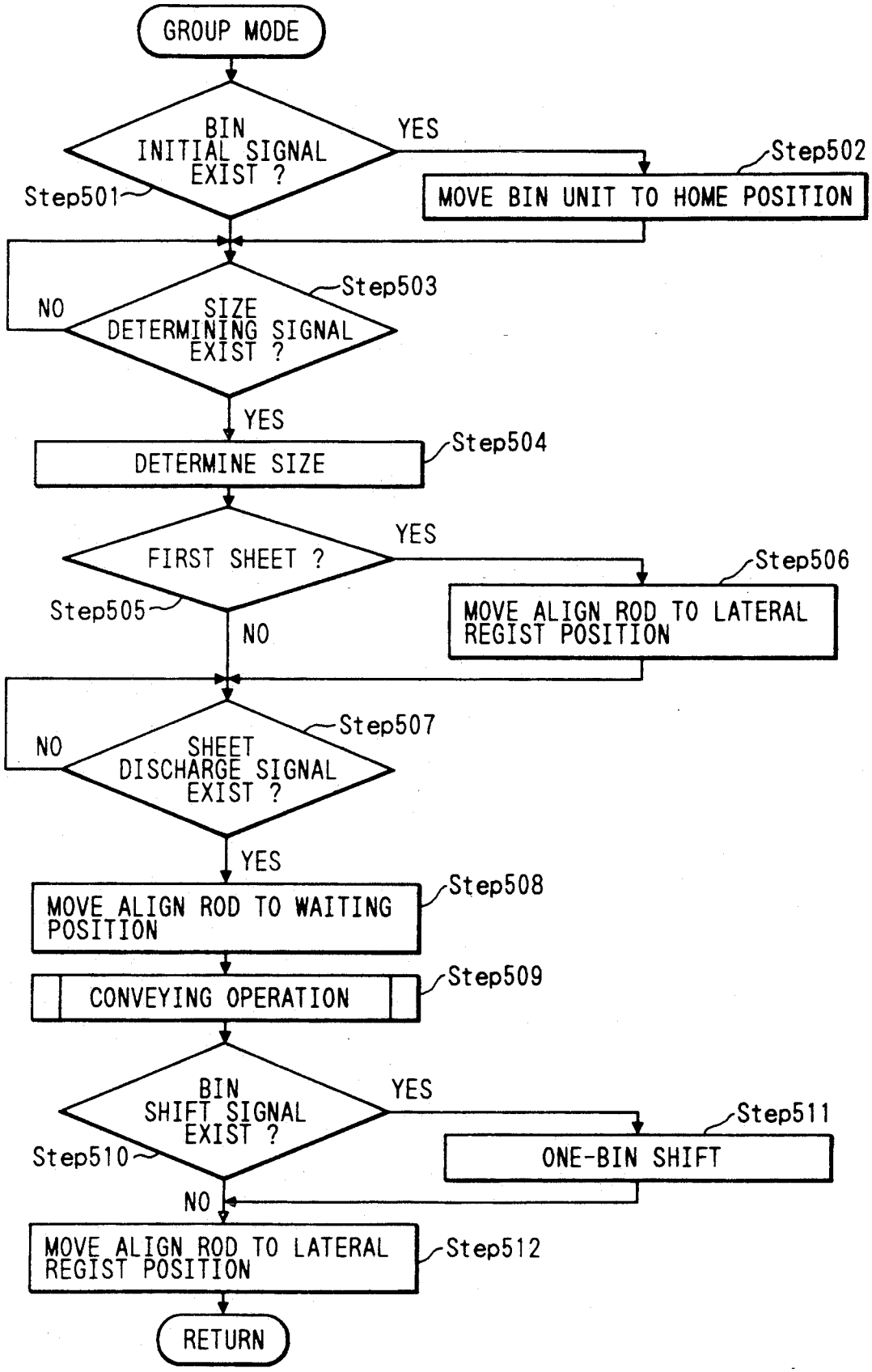

In the following there will be explained the function in the group mode, with reference to FIG. 26.

At first there is discriminated whether the bin initial signal from the main body of the copying machine is present (step 501), and, if present, the bin unit 2 is moved to the home position (step 502). Then, upon reception of the size determination signal (step 503), a step 504 determines the sheet size, and a step 505 discriminates whether said size determination is for the 1st sheet. If for the 1st sheet, the alignment rod 26 is moved to the alignment position 26*a* (step 506), and, upon reception of the sheet discharge signal (step 507), the alignment rod 26 is moved to the standby position 26*b* (step 508). After the sheet transportation into the bin B (step 509), a step 510 discriminates whether a bin shift signal from the main body is present (step 509), and, if present, the bins B are shifted by a bin (step 511). Then the alignment rod 26 is moved to the alignment position 26*a* for aligning the sheets (step 512) and the sequence returns to the main routine.

Figure 27:
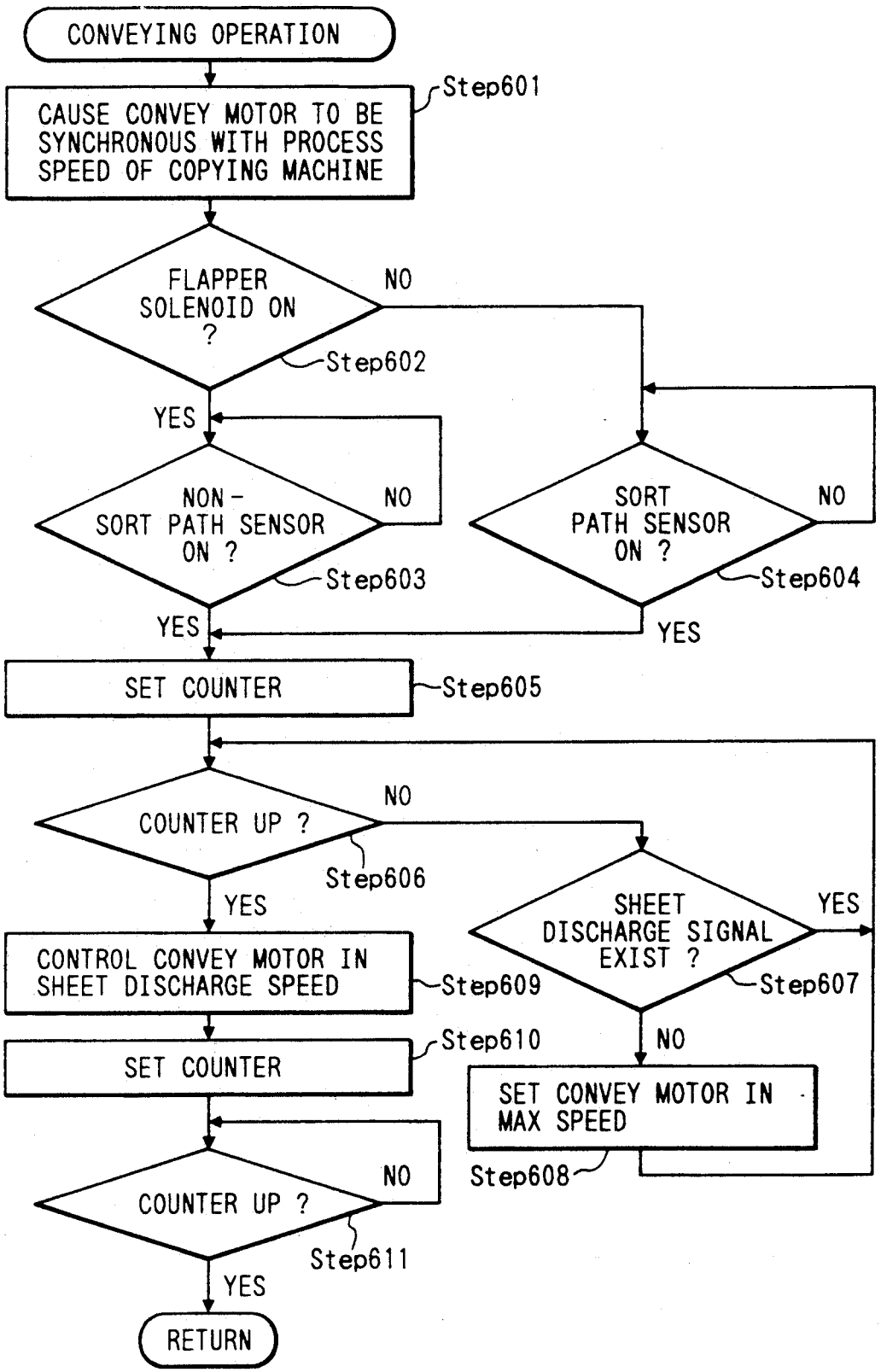

In the following there will be explained the transporting operation, with reference to FIG. 27.

When the sorter 1 receives a sheet from the main body, if the transporting speed of said sheet in said sorter is lower than that in the main body, the sheet generates a loop between the main body and the sorter, thereby resulting in sheet jamming. On the other hand, if the sheet transporting speed in the sorter is higher than that in the main body, the sheet is pulled by two units, and there is generated danger of noises or sheet breakage. Consequently the sheet transporting speed of the sorter 1 is synchronized with the process speed of the main body (step 601).

Then there is discriminated whether the flapper solenoid is energized, namely whether the upper discharge rollers 15 or the lower discharge rollers 16 are selected (step 602). The sequence then proceeds to a step 603 for detection with the non-sort path sensor S1 if the flapper solenoid 122 is energized to select the non-sort discharge position 15, or to a step 604 for detection with the sort path sensor S2 if the flapper solenoid 122 is turned off to select the sorting discharge position 16. The step 603 or 604 waits until the non-sort path sensor or the sort path sensor is turned on, and the sequence proceeds then to a step 605 for setting a counter for measuring the position for controlling the discharge timing of the transport motor 117. Then a step 606 discriminates whether the counter, set in the step 605, has completed the counting operation, and the sequence proceeds to a step 609 or 607 respectively if the counting is completed or not. The step 607 discriminates the presence of the sheet discharge signal from the main body, and, if absent, the sheet is identified to have been completely discharged from the main body of the copying machine and the transport speed is increased to the maximum value (step 608). After the step 608 identifies the point of controlling the discharge timing, a step 609 controls the transport motor 117 to the sheet discharge speed of the main body. Thereafter a counter is set for measuring the position of completion of discharge (step 610), and the sequence is terminated when the counting operation is completed (step 611).

Figure 28:
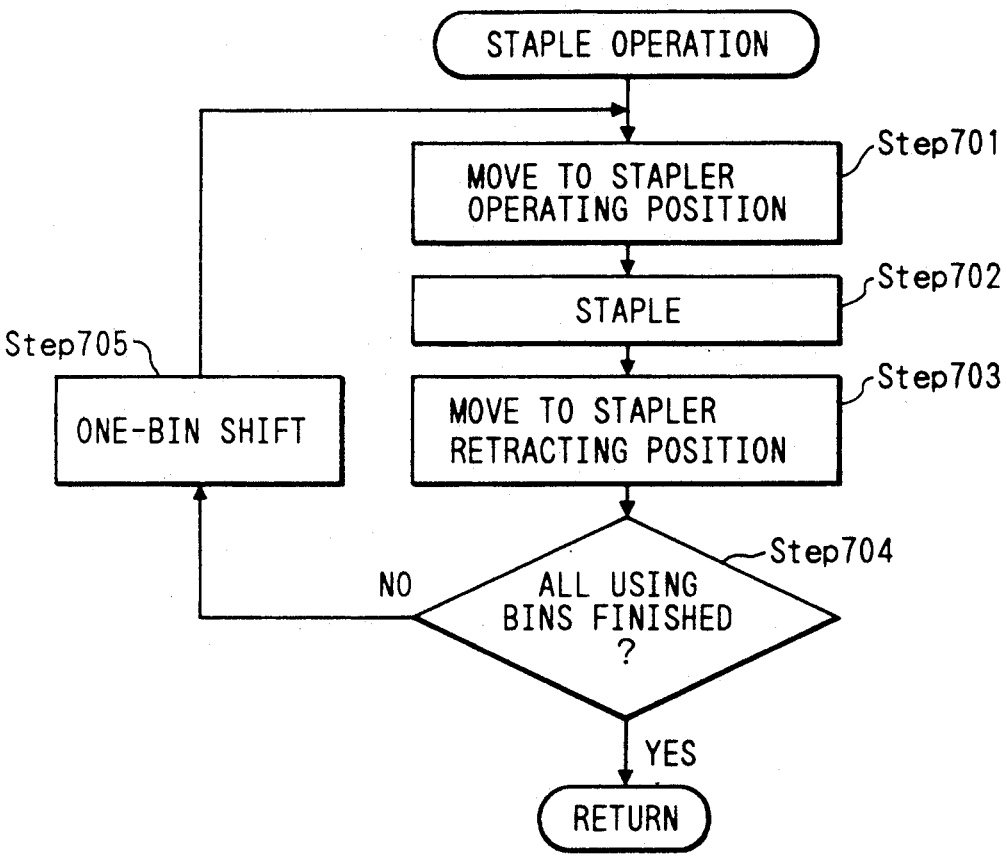

In the following there will be explained the stapling operation, with reference to FIG. 28.

At first a step 701 activates a stapler moving motor 119 for moving the stapler 67, until a stapler work position sensor S7 and a stapler positioning sensor S6 are both activated, namely until the stapler 67 moves to a work position 67*a*.

Then a stapler motor 71 is activated to effect a stapling operation. After the start of said stapler motor 71, there is confirmed the turning-off of a stapler cam sensor S10, and a stapling operation is completed by turning off the stapler motor 71 after the turning-on of said sensor S10, namely after a full turn (step 702). Subsequently the stapler moving motor 119 is activated until the stapler work position sensor S7 is turned off and the stapler positioning sensor S6 is turned on, namely until the stapler 67 is retracted to a position 67*b* (step 703). Then there is discriminated whether the stapling operation is conducted on all the bins B (step 705), and, if not, the bins are shifted by a bin, and the sequence proceeds to the step 701 for a next stapling operation. If the stapling operation has been conducted on all the bins, the stapling sequence is terminated.

Figure 29:
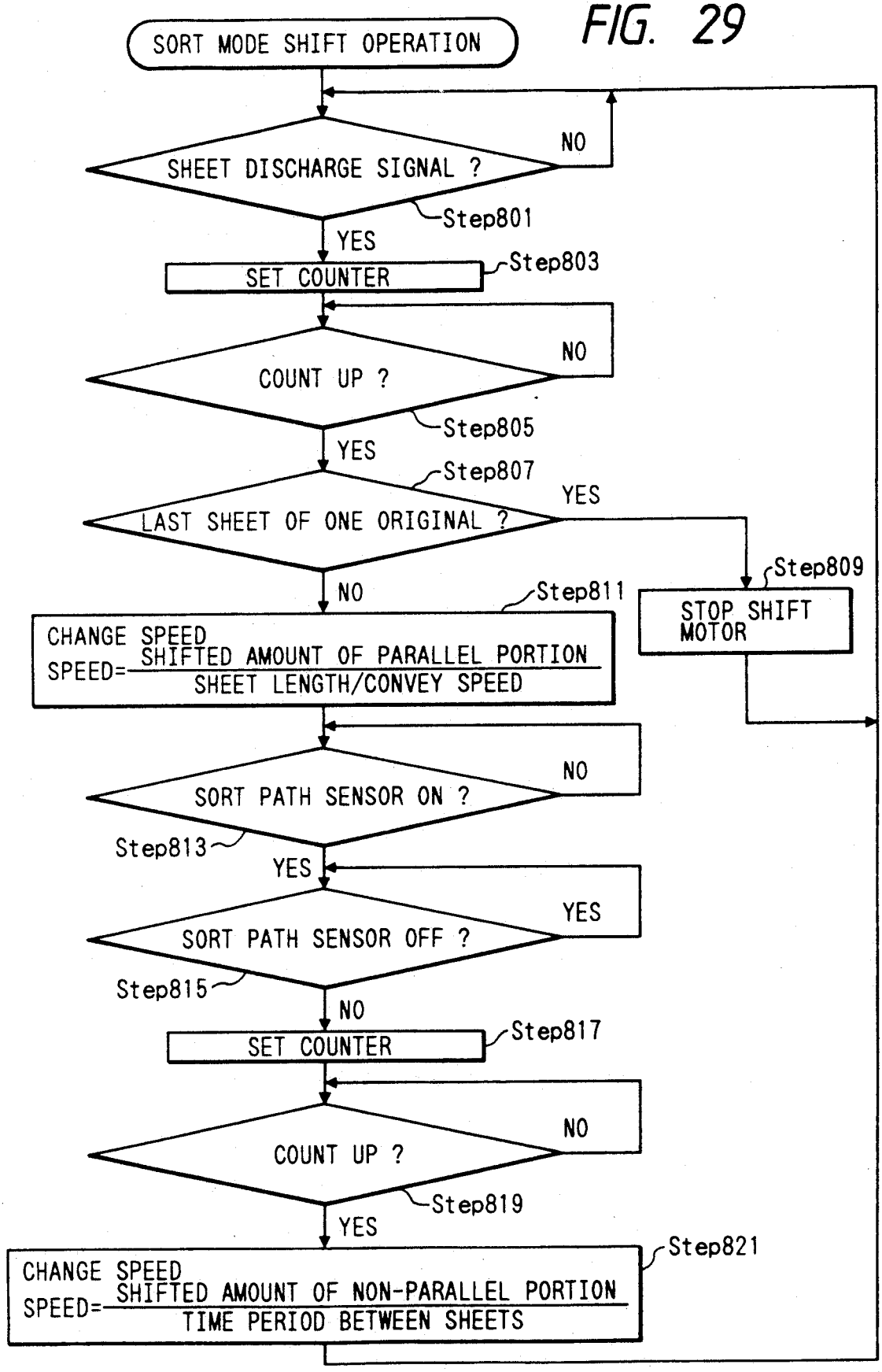

In the following there will be explained the shifting operation in the sorting mode, which is most characteristic of the present invention, with reference to FIG. 29.

In the shifting operation in the sorting mode, the sheet discharge signal from the image forming apparatus is monitored for synchronization with the sheet P (step 801). Upon reception of said sheet discharge signal, the moment of entry of the leading end of the sheet P into the bin B is synchronized with the end of the parallel portion of the lead cams 43. More specifically, a counter for synchronization is set (step 803), and, upon completion of the counting operation (step 805), the sequence proceeds to a step 807.

The step 807 discriminates whether the sheet is the last sheet of a series of originals, and, if it is the last sheet, the rotation of the lead cams 43 is terminated (step 809).

If not the last sheet, the sequence proceeds to a step 811 to vary the speed of the lead cams 43. The speed in this state can be obtained by dividing the length of the parallel portion thereof by the time, obtained by dividing the length of sheet by the transport speed. Said sheet length is supplied from the main body by serial communication shown in FIG. 21.

Then a step 813 awaits the turning-on, of the sort path sensor S2, and a step 815 awaits the turning-off thereof, in order to detect the rear end of the sheet P. Then there is set a counter for counting the period from the detection of the rear end of the sheet P to the completion of sheet storage into the bin B (step 817), and, upon completion of the counting operation (step 819), the sequence proceeds to a step 821.

The step 821 varies the speed to the shifting speed in the interval of sheets, and said shifting speed is determined by dividing the amount of movement in the non-parallel portion by the interval which is supplied by serial communication from the main body. After the determination of the shifting speed, the sequence returns to the step 801 for processing the next sheet P.

In the following there will be explained the speed control of the shift motor 45, with reference to FIG. 30.

The control of the shift motor 45 is achieved by the timer interruption function and the clock interruption function of the CPU 111.

The timer interruption function is to generate interruption at an arbitrary interval by a hardware counter in the CPU 111, while the clock interruption function is to generate interruption at the edge of an external pulse. In this embodiment, the clock interruption is achieved by a clock pulse from a clock sensor S13 of the encoder of the shift motor 45.

This control is achieved by setting the interval of the timer interruption at an ideal time for clock interruption when the shift motor 45 is at the target speed, and controlling the count of an up-down counter, for measuring the difference between said ideal time and the number of clocks for interruption, to zero, thereby obtaining the ideal speed.

Figure 30A:
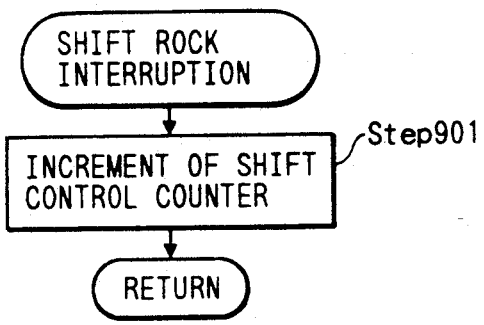
Figure 30B:
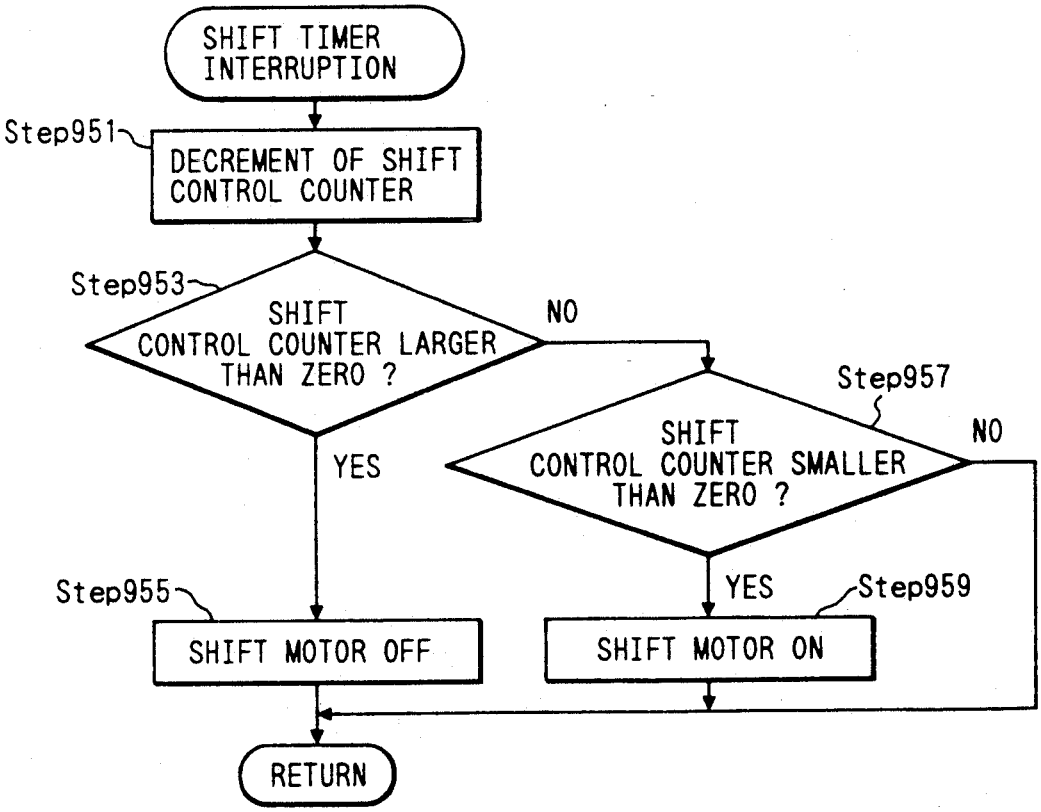

Flow charts of the above explained control are shown in FIGS. 30A and 30B.

FIG. 30A shows the procedure of clock interruption by increasing the count of the shift control up-down counter, provided in the RAM 113.

FIG. 30B shows the procedure of timer interruption. At first a step 951 effects a decrement of the shift control counter. Then the on-off state of the shift motor 45 is determined by discriminating whether the count of the shift control counter is larger than zero (step 953), and, if larger than zero, turning off the shift motor 45 as the speed thereof is too large (step 955). On the other hand, if the step 953 identifies that the count of the shift control counter is zero or smaller, a step 957 discriminates whether said count is smaller than zero.

If said count is not smaller than zero, said count is zero, indicating the target speed, and the timer interruption procedure is terminated. If said count is smaller than zero, indicating a speed slower than the target, the shift motor 45 is turned on (step 959) and the timer interruption procedure is terminated. The speed control of the shift motor 45, controlling the vertical movement of the bin unit 2 and the widening operation of the bins B is achieved in this manner.

In the above-explained embodiment, the spiral cams need not necessarily be provided with parallel portions, but may be rotated at a relatively low speed in continuous manner, in synchronization with the sheet discharge. Consequently the conventional spiral cams shown in FIG. 3 may also be employed in the present invention.

In the following there will be explained application of the present invention to a facsimile apparatus or a printer.

Figure 32:
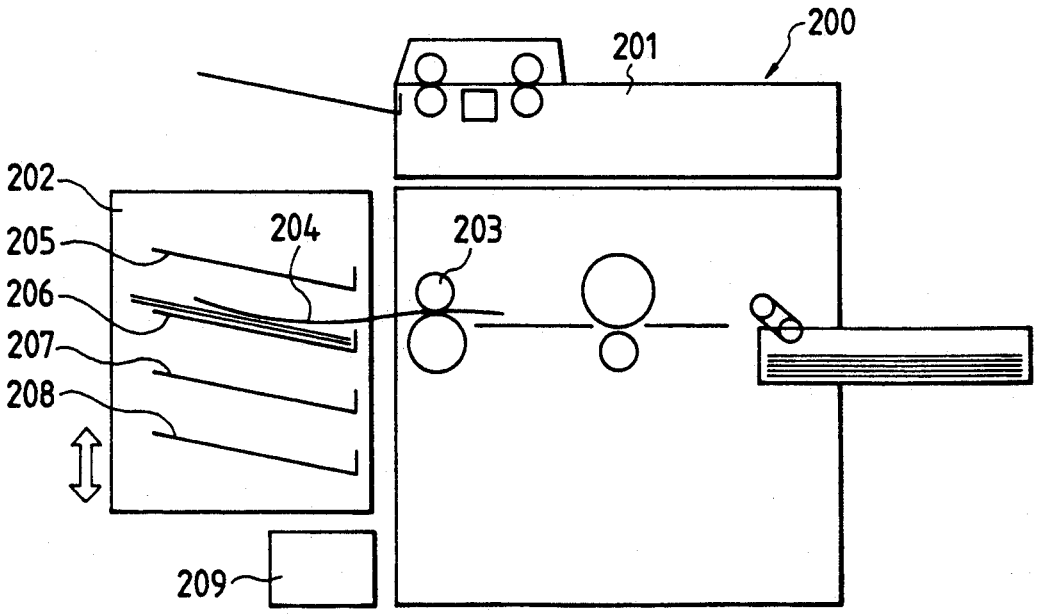
FIG. 32 is a cross-sectional view of a facsimile apparatus.

FIG. 32 is a schematic view of another embodiment in which the image forming apparatus is composed of a facsimile apparatus, wherein shown are a main body 200 of the facsimile apparatus; an original reading unit 201; a collator 202 provided in the recording unit of the main body 200; a sheet discharge unit 203 of the main body 200; a received document 204; bin trays 205–208; and a driving unit 209 of the collator.

In response to a control signal from the main body 200 of the facsimile apparatus, the driving unit 209 of the collator moves the bin trays 205~208 vertically to align one of said bin trays with the sheet discharge unit 203, and the received document 204 is placed on thus aligned bin tray. The uppermost bin tray 205 can stack a larger number of documents than in other bin trays 206–208, because of the available upper space.

Figure 33:
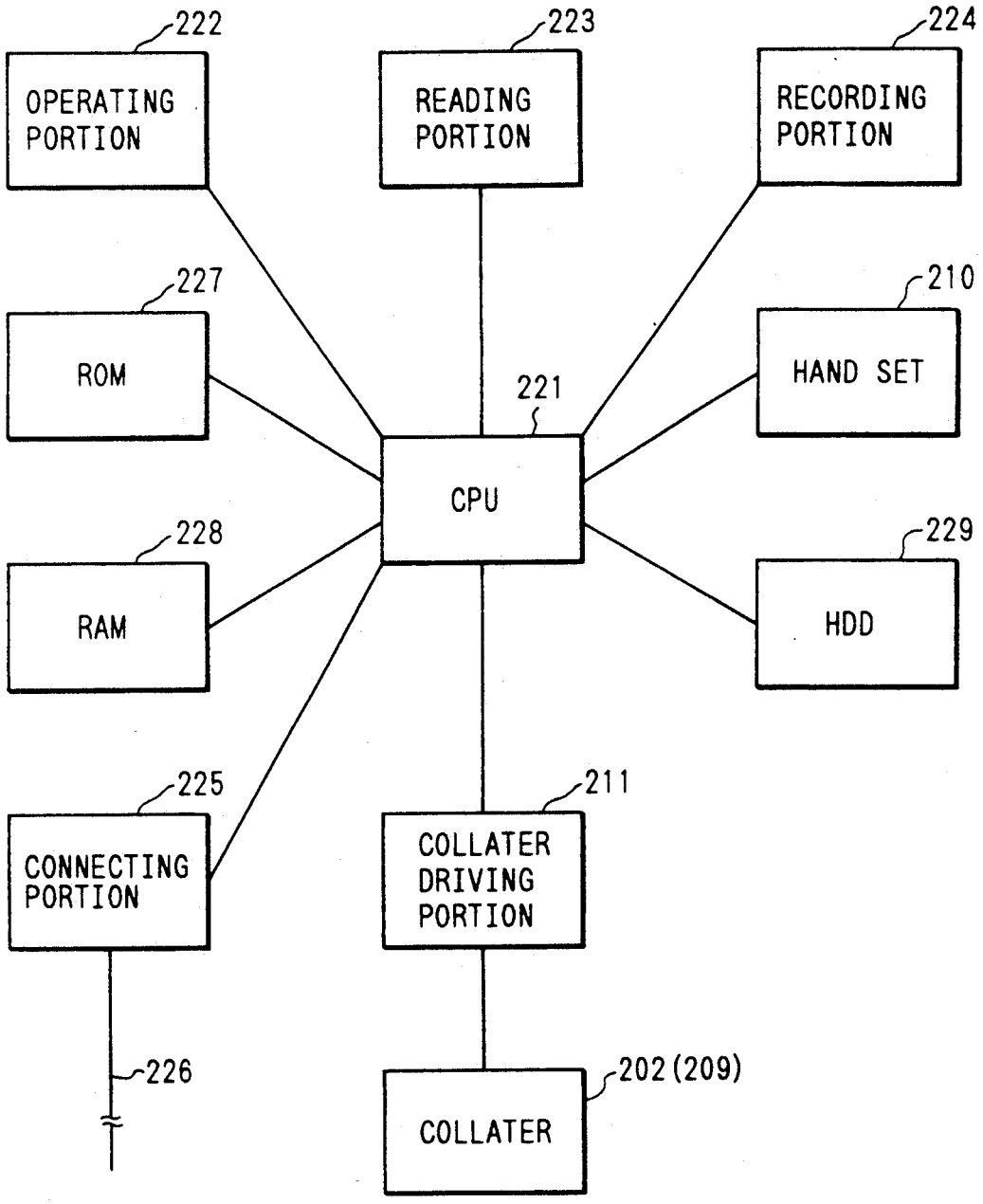
FIG. 33 is a block diagram of a control unit employed in the apparatus shown in FIG. 32.

FIG. 33 shows the structure of control system in the facsimile apparatus shown in FIG. 32.

In FIG. 33, a CPU 221 for controlling the various units of the facsimile apparatus is composed for example of a microprocessor. The control system of the facsimile apparatus is composed of star-shaped connection of the components 222~212 to said CPU 221.

Said components consist of an operation unit 222 for input of instructions for facsimile operations and for information display; a reading unit 223 for reading the image of an original; a recording unit 224 for image output; a connector 225 such as modem or DSU between the facsimile apparatus and a communication network; a communication line 226; a ROM 227 storing, for example, the control program of the CPU 221; a RAM 228 for temporary storage of various data and image information; a rigid disk drive 229 functioning as a non-volatile memory for storing image information or the like; a handset 210; a collator control unit 211; and a collator 202 (209).

In the above-explained facsimile apparatus, the collator 202 (209) is controlled in the same manner as in the copying machine explained above. For example, in case of receiving the sheets of a communication in a bin tray and receiving those of another communication in another bin tray, the bin trays are shifted by continuous rotation of a motor.

Figure 34:
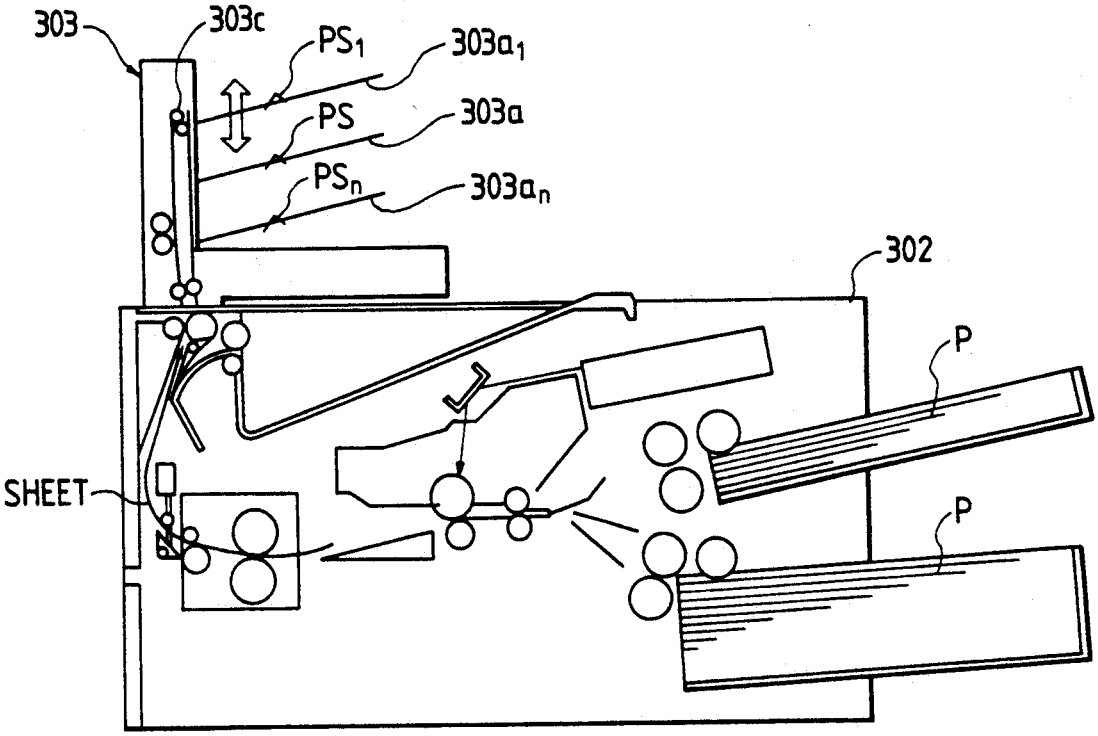
FIG. 34 is a cross-sectional view of a printer.
Figure 35:
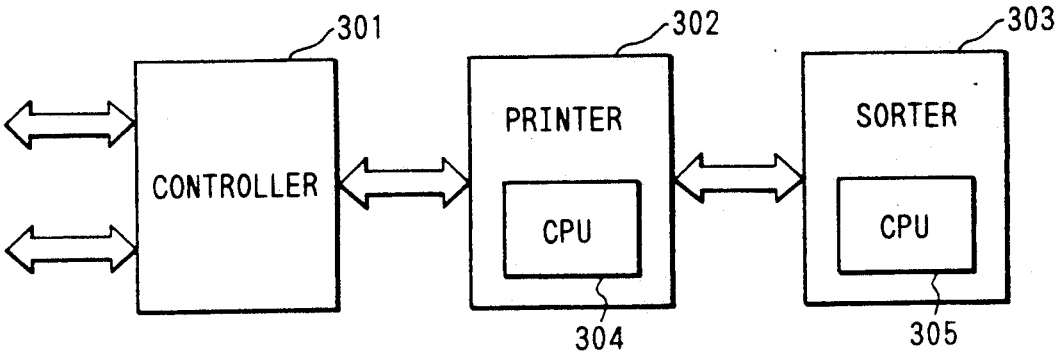
FIG. 35 is a block diagram of a control unit employed in the apparatus shown in FIG. 34.

FIGS. 34 and 35 show a laser beam printer as another embodiment of the image forming apparatus.

FIG. 35 is a block diagram of the present embodiment, composed of a controller 301 connected to plural host computers; a printer 302 connected to said controller 301; and a sorter 303 connected to said printer 302. The printer 302 and the sorter 303 are respectively provided with independently operating CPU's 304, 305 each having a ROM and a RAM, and these units mutually exchange information and data by parallel or serial communication. In response to a print instruction from one of the host computers, the controller 301 generates an ID number for each host computer and each instruction (job) and sends it to the printer 302, which transmits said ID number to the sorter 303. In response to said ID number, the sorter 303 designates a bin of the sorter, and sends the bin number, corresponding to said ID number, to the controller 301 through the printer 302.

The sorter 303 is provided, in addition to the CPU 305, with empty bin sensors PS1 ~ PSn for detecting the presence of sheets in each bin 303*a*. Also there are provided a motor for driving the bin moving means for discharging sheet into each bin, a driver therefor, a motor for driving discharge rollers 303*c*, etc., and a driver therefor.

Also in this embodiment shown in FIGS. 34 and 35, the sorter 303 is controlled according to the sheet transport speed of the printer 302, as in the foregoing embodiments.

The embodiment shown in FIG. 34 is provided with a laser beam printer, but there may be employed the recording unit of another type. For example, an ink jet printer is characterized by low noise level, and can be advantageously employed in combination with the low-noise sorter of the present invention.

The ink jet recording utilizes a liquid discharge opening for discharging recording liquid ink as a flying droplet; a liquid path communicating with said discharge opening; and discharge energy generating means provided in a part of said liquid path and serving to provide the discharge energy for causing the liquid ink in said path to fly. Said energy generating means is driven according to image signal, thereby discharging the ink droplets and recording an image.

For said discharge energy generating means, there may be employed pressure energy generating means, for example an electromechanical converter such as a piezoelectric device; electromagnetic energy generating means such as a laser which heats the liquid ink with an electromagnetic emission thereby discharging the ink by said heating; or thermal energy generating means for heating the liquid ink with an electrothermal converter thereby discharging the ink. Among these methods, so-called bubble jet recording method, in which the ink discharge is caused by thermal energy generating means such as an electrothermal converter, can be advantageously employed since recording with a high resolving power can be achieved with a high-density arrangement of discharge openings and since the recording head can be realized in a compact form.

What is claimed is:

1. A sheet sorting apparatus comprising:

plural bin trays;

bin tray moving means for moving said bin trays stepwisely to cause each of the bin trays to face a sheet receiving position; and control means for variably controlling the operating speed of said bin tray moving means according to sheet transporting information from an image forming apparatus to be connected to said sorting apparatus in such a manner that said bin tray moving means can be operated in a continuous manner even during discharge of a sheet into a bin tray, wherein said control means comprises calculation means for calculating the operating speed of said bin tray moving means based on the sheet transporting information supplied from said image forming apparatus so that the bin which is subject to receive the sheet faces the sheet receiving position until the sheet receiving has been completed, and the subsequent bin tray comes to the sheet receiving position before discharge of subsequent sheets is started.

2. An apparatus according to claim 1, wherein said bin tray moving means is adapted to vertically move said bin trays, while widening the spaces thereof.

3. An apparatus according to claim 2, wherein said bin tray moving means is means for rotating spiral cams.

4. An apparatus according to claim 2, wherein said bin tray moving means is a geneva rotary member.

5. An apparatus according to claim 1, wherein said image forming apparatus is a copying machine.

6. An apparatus according to claim 1, wherein said image forming apparatus is a printer.

7. An apparatus according to claim 1, wherein said image forming apparatus is a facsimile apparatus.

8. A sheet sorting apparatus according to claim 1, wherein said bin tray moving means is a spiral cam rotating member on which a spiral having a parallel portion is formed to discharge the sheet when the trunnion of said bin tray is positioned on the parallel portion; and said control means adjusts the timing of starting point of the parallel portion and the sheet discharge.

9. An image forming apparatus comprising:

image forming means;

plural bin trays;

bin tray moving means for moving said bin trays stepwisely to cause each of the bin trays to face a sheet receiving position; and control means for controlling the operating speed of said bin tray moving means according to sheet transporting information in such a manner that said bin tray moving means is operable in a continuous manner even during the discharge of a sheet into a bin tray, wherein said control means comprises calculation means for calculating the operating speed of said bin tray moving means based on the sheet transporting information supplied from said image forming apparatus so that the bin which is subject to receive the sheet faces the sheet receiving position until the sheet receiving has been completed, and the subsequent bin tray comes to the sheet receiving position before discharge of subsequent sheets is started.

10. An apparatus according to claim 9, wherein said bin tray moving means is adapted to vertically move said bin trays, while widening the spaces therebetween.

11. An apparatus according to claim 10, wherein said bin tray moving means is means for rotating spiral cams.

12. An apparatus according to claim 10, wherein said bin tray moving means is a geneva rotary member.

13. A sheet sorting apparatus comprising:

plural bins each having a trunnion at an end thereof;

sheet discharge means for discharging sheets, transported from an image forming apparatus, into said bins;

spiral cam means for moving said trunnions of said bins in such a manner as to widen the space of the bins at a position facing said sheet discharge means, wherein a substantially horizontal portion, of a predetermined amount is provided on the cam portion of said spiral cam means, said spiral cam means is maintained in continuous rotation;

means for detecting a rotary position of said spiral cam means, to determine whether it is in a sheet discharge position in which said trunnion is in the substantially horizontal portion of the spiral cam means and a shift position in which said trunnion is in an inclined portion of said spiral cam means; and control means for controlling said spiral cam means so that the discharge operation of said sheet discharge means is synchronized with the passing of said trunnion through the substantially horizontal portion of said spiral cam means, said control means being adapted to vary the revolving speed of said spiral cam means is response to detection by said detecting means.

14. An apparatus according to claim 13, further comprising a control circuit capable, in response to a sheet discharge signal from said image forming apparatus, of synchorinizing the timing of start of discharge of said sheet with the timing of start of said substantially parallel portion in the rotation of said spiral cam means.

15. A sheet sorting apparatus comprising:

plural bins each having a trunnion at an end thereof;

sheet discharge means for discharging sheets, transported from an image forming apparatus, into said bins;

spiral cam means for moving said trunnions of said bins in such a manner as to cause each of said bins to face said sheet discharge means, wherein a substantially horizontal portion of a predetermined amount is provided on the cam portion of said spiral cam means, said spiral cam means is maintained in continuous rotation;

means for detecting a rotary position of said spiral cam means to determine whether it is in a sheet discharge position in which said trunnion is on the substantially horizontal portion of the spiral cam means and a shift position in which said trunnion is on an inclined portion of said spiral cam means; and control means for controlling said spiral cam means so that the discharge operation of said sheet discharge means is synchronized with the passing of said trunnion through the substantially horizontal portion of said spiral cam means, said control means being adapted to vary the revolving speed of said spiral cam means in response to detection by said detecting means.

16. An image forming apparatus comprising:

plural bins each having a trunnion at an end thereof;

sheet discharge means for discharging sheets, transported from an image forming means, into said bins;

spiral cam means for moving said trunnions of said bins in such a manner as to cause each of said bins to face said sheet discharge means, wherein a substantially horizontal portion of a predetermined amount is provided in the cam portion of said spiral cam means, said spiral cam means is maintained in continuous rotation;

means for detecting a rotary position of said spiral cam means, to determine whether it is in a sheet discharge position in which said trunnion is on the substantially horizontal portion of the spiral cam means and a shift position in which said trunnion is on an inclined portion of said spiral cam means; and control means for controlling said spiral cam means so that the discharge operation of said sheet discharge means is synchronized with the passing of said trunnion through the substantially horizontal portion of said spiral cam means, said control means being adapted to vary the revolving speed of said spiral cam means in response to detection by said detecting means.

17. A sheet sorting apparatus comprising:

plural bins each having a trunnion at an end thereof;

sheet discharge means for discharging sheets, transported from an image forming apparatus, into said bins;

spiral cam means for moving said trunnions of said bins by grooves of said cam means in such a manner as to cause each of said bins to face said sheet discharge means, wherein a substantially parallel portion of a predetermined amount is provided on the cam portion of said spiral cam means, said spiral cam means is maintained in continuous rotation;

means for detecting a rotary position of said spiral cam means to determine whether it is in a sheet discharge position in which said trunnion is in the substantially parallel portion of the spiral cam means and a shift position in which said trunnion is in an inclined portion of said spiral cam means; and control means for controlling said spiral cam means so that the discharge operation of said sheet discharge through the substantially parallel portion of said spiral cam means, said control means being adapted to vary the revolving speed of said spiral cam means in response to detection by said detecting means.

18. A sheet sorting apparatus, comprising:

plural bins each having a trunnion;

sheet discharge means for discharging sheets transported from an image forming apparatus into said bins;

spiral cam means, comprising two cam lines, for moving said trunnions of said bins in such a manner as to cause each of said bins to face said sheet discharge means, wherein a substantially horizontal cam line of a predetermined amount is provided at an intermediate portion of the cam lines of said spiral cam means, said spiral cam means being maintained in continuous rotation, and wherein said trunnion reaches to said intermediate portion from a lower or an upper portion by one revolution of said spiral cam means and it reaches from the lower portion to the upper portion, or from the upper portion to the lower portion of said spiral cam means by two revolutions of said spiral cam means;

means for detecting a rotary position of said spiral cam means to determine whether it is in a sheet discharge position in which said trunnion is on the substantially horizontal cam lines of said spiral cam means or in a shift position in which said trunnion is on an inclined cam line of said spiral cam means; and control means capable, in response to said detecting means, of synchronizing the discharge operation of said sheet discharge means with the passing timing of said trunnion through said substantially horizontal cam lines in the rotation of said cam means.

19. A sheet sorting apparatus according to claim 18, wherein said bin tray in which the trunnion is provided at the intermediate portion faces to said discharge means and is maintained with a large gap between the upper and lower bins; and said sheet sorting apparatus further is provided with stapler means to staple the sheet on the bin facing with said discharge means.

20. A sheet sorting apparatus, comprising:

plural bins each having a trunnion;

sheet discharge means for discharging sheets, transported from an image forming apparatus, into said bins;

spiral cam means for moving said trunnions of said bins in such a manner as to cause each of said bins to face said sheet discharge means, wherein a substantially horizontal portion of a predetermined amount is provided on the cam portion of said spiral cam means and said spiral cam means is maintained in continuous rotation;

means for detecting a rotary position of said spiral cam means to determine whether it is in a sheet discharge position in which said trunnion is on the substantially horizontal portion of spiral cam means, or a shift position in which said trunnion is on an inclined portion of said spiral cam means; and control means capable, in response to said detecting means, of synchronizing the discharge operation of said sheet discharge means with the passing timing of said trunnion through said substantially horizontal portion in the rotation of said spiral cam means.

21. An image forming apparatus, comprising:

plural bins each having a trunnion;

sheet discharge means for discharging sheets, transported from an image forming apparatus, into said bins;

spiral cam means for moving said trunnions of said bins in such a manner as to cause each of said bins to face said sheet discharge means, wherein a substantially horizontal portion of a predetermined amount is provided on the cam portion of said spiral cam means and said spiral cam means is maintained in continuous rotation;

means for detecting a rotary position of said spiral cam means to determine whether it is in a sheet discharge position in which said trunnion is on the substantially horizontal portion of spiral cam means, or a shift position in which said trunnion is on an inclined portion of said spiral cam means; and control means capable, in response to said detecting means, of synchronizing the discharge operation of said sheet discharge means with the passing timing of said trunnion through said substantially horizontal portion in the rotation of said spiral cam means.

22. An image forming apparatus, comprising:

plural bins each having a trunnion;

sheet discharge means for discharging sheets transported from an image forming means into said bins;

spiral cam means, comprising two cam lines, for moving said trunnions of said bins in such a manner as to cause each of said bins to face said sheet discharge means, wherein substantially horizontal cam lines of a predetermined amount is provided at an intermediate portion of the cam line of said spiral cam means, said spiral cam means is maintained in continuous rotations, and wherein said trunnion reaches to said intermediate portion from a lower or an upper portion by one revolution of said spiral cam means and it reaches from the lower portion to the upper portion or from the upper portion to the lower portion of said spiral cam means by two revolutions of said spiral cam means;

means for detecting the rotary position of said spiral cam means to determine whether it is in a sheet discharge position in which said trunnion is on the substantially horizontal cam lines of said spiral cam means or in a shift position in which said trunnion is on an inclined cam line of said spiral cam means; and control means capable, in response to said detecting means, of synchronizing the discharging operation of said sheet discharge means with the passing timing of said trunnion through said substantially horizontal cam lines in the rotation of said spiral cam means.

* * * * *

UNITED STATES PATENT AND TRADEMARK OFFICE

CERTIFICATE OF CORRECTION

PATENT NO. : 5,255,908

DATED : October 26, 1993

INVENTOR(S) : MASAKAZU HIROI, ET AL.

It is certified that error appears in the above-indentified patent and that said Letters Patent is hereby corrected as shown below:

COLUMN 1

Line 41, "4,337,936and" should read --4,337,936 and--.

COLUMN 3

Line 7, "is" should read --are--.

COLUMN 6

Line 63, "different" should read --difference--.

COLUMN 8

Line 43, "suitable" should read --suitably--;

Line 51, "longer" should read --longer be--.

COLUMN 9

Line 24, "allows to recognize" should read --allow recognition of--.

COLUMN 19

Line 32, "is" should read --in--;

Line 37, "synchorinizing" should read --synchronizing--.

UNITED STATES PATENT AND TRADEMARK OFFICE

CERTIFICATE OF CORRECTION

PATENT NO. : 5,255,908
DATED : October 26, 1993
INVENTOR(S) : MASAKAZU HIROI, ET AL.

It is certified that error appears in the above-indentified patent and that said Letters Patent is hereby corrected as shown below:

COLUMN 20
Line 46, "change through" should read --change means is synchronized with the passing of said trunion through--.

COLUMN 22
Line 11, "spiral" should read --said spiral--;
Line 27, "is" should read --are--.

COLUMN [57] ABSTRACT
Line 8, "said" should read --the--;
Line 9, "means" should read --device--.

Signed and Sealed this

Thirty-first Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,255,908

DATED : October 26, 1993

INVENTOR(S) : Masakazu Hiroi, et al.

It is certified that error appears in the above-indentified patent and that said Letters Patent is hereby corrected as shown below:

Column 21, line 49, "apparatus" should read --means--.

Signed and Sealed this

Sixth Day of September, 1994

*Attest:*

Bruce Lehman

BRUCE LEHMAN

*Attesting Officer*

*Commissioner of Patents and Trademarks*